US009581019B2

(12) United States Patent
Chang et al.

(10) Patent No.: US 9,581,019 B2
(45) Date of Patent: Feb. 28, 2017

(54) MEASUREMENT PRETEST DRAWDOWN METHODS AND APPARATUS

(75) Inventors: Yong Chang, Missouri City, TX (US); Julian J. Pop, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 13/069,674

(22) Filed: Mar. 23, 2011

(65) Prior Publication Data

US 2012/0253679 A1 Oct. 4, 2012

(51) Int. Cl.

| | |
|---|---|
| ***G01V 1/40*** | (2006.01) |
| ***G01V 3/18*** | (2006.01) |
| ***E21B 49/00*** | (2006.01) |
| ***E21B 49/08*** | (2006.01) |

(52) U.S. Cl.

CPC ..... *E21B 49/008* (2013.01); *E21B 49/088* (2013.01)

(58) Field of Classification Search

CPC ..... E21B 47/187; E21B 49/008; E21B 49/088
USPC ..... 702/11, 6; 324/601
See application file for complete search history.

(56) References Cited

U.S. PATENT DOCUMENTS

| | | | | |
|---|---|---|---|---|
| 3,859,851 | A | 1/1975 | Urbanosky | |
| 4,860,581 | A | 8/1989 | Zimmerman et al. | |
| 4,936,139 | A | 6/1990 | Zimmerman et al. | |
| 6,230,557 | B1 | 5/2001 | Ciglenec et al. | |
| 6,986,282 | B2 | 1/2006 | Ciglenec et al. | |
| 7,114,562 | B2 | 10/2006 | Fisseler et al. | |
| 7,805,247 | B2 * | 9/2010 | Hsu et al. | 702/6 |
| 2002/0146927 | A1 | 10/2002 | Uchibori et al. | |
| 2004/0045706 | A1 * | 3/2004 | Pop et al. | 166/250.07 |
| 2004/0050588 | A1 * | 3/2004 | Follini et al. | 175/50 |
| 2004/0173351 | A1 * | 9/2004 | Fox et al. | 166/264 |

(Continued)

FOREIGN PATENT DOCUMENTS

| | | |
|---|---|---|
| RU | 2391503 C2 | 6/2006 |
| RU | 2316650 C2 | 2/2008 |

OTHER PUBLICATIONS

International Search Report and Written Opinion for International Application No. PCT/US2012/030098 dated Oct. 31, 2012.

(Continued)

*Primary Examiner* — Gregory J Toatley
*Assistant Examiner* — Eman Alkafawi

(57) ABSTRACT

Methods of and apparatus to perform a drawdown of a formation fluid in a downhole environment are disclosed. An example method includes contacting a borehole wall with a fluid communication device of a formation testing tool and performing a first type of drawdown to draw fluid into the fluid communication device. The method also includes detecting a breach of a mudcake on the borehole wall during performance of the first type of drawdown and performing a second type of drawdown to draw fluid into the sample probe in response to detecting the breach of the mudcake. The second type of drawdown is different than the first type of drawdown. Furthermore, the example method includes confirming the breach of the mudcake on the borehole wall during performance of the second type of drawdown.

17 Claims, 14 Drawing Sheets

(56) References Cited

U.S. PATENT DOCUMENTS

| | | | | |
|---|---|---|---|---|
| 2005/0171699 | A1* | 8/2005 | Zazovsky | E21B 49/008 702/11 |
| 2007/0198192 | A1* | 8/2007 | Hsu et al. | 702/6 |
| 2008/0087470 | A1* | 4/2008 | Villareal et al. | 175/50 |
| 2008/0259727 | A1* | 10/2008 | Drew | 367/25 |
| 2009/0165548 | A1* | 7/2009 | Pop et al. | 73/152.51 |
| 2009/0314077 | A1* | 12/2009 | Tustin et al. | 73/152.24 |
| 2010/0050762 | A1 | 3/2010 | Nold, III et al. | |
| 2010/0264915 | A1 | 10/2010 | Saldungaray et al. | |
| 2011/0162848 | A1* | 7/2011 | Duffy et al. | 166/305.1 |

OTHER PUBLICATIONS

Decision to Grant in related RU application 2013147141 on Aug. 21, 2015, 18 pages.

First Office Action issued in related CN application CN201280024874 on Sep. 14, 2015, 22 pages.

Examination Report issued in related CA application 2830789 on Oct. 16, 2015, 3 pages.

Extended European Search Report issued in related EP application 12760713.3 on Mar. 22, 2016, 9 pages.

Office Action No. 26445 issued in related MX application MX/a/2013/010756 on Apr. 11, 2016, 7 pages.

Examination Report issued in related CA application 2830789 on Jan. 30, 2015, 4 pages.

* cited by examiner

Pressure
Injector Volume
410
412
414
420
421
425
430
440
450
$t_{-1}$
$t_0$
$t_d$
$t_1$
$t_2$
$T_0$
$T_D$
$T_1$
$\delta_0$
$\Delta p$
$P_{410}$
$P_{414}$
$P_{440}$
$q_1$

MEASUREMENT PRETEST DRAWDOWN METHODS AND APPARATUS

BACKGROUND OF THE DISCLOSURE

Over the past several decades, highly sophisticated techniques have been developed for identifying and producing hydrocarbons, commonly referred to as oil and gas, from subsurface formations. These techniques facilitate the discovery, assessment, and production of hydrocarbons from subsurface formations.

When a subsurface formation containing an economically producible amount of hydrocarbons is believed to have been discovered, a borehole is typically drilled from the earth surface to the desired subsurface formation and tests are performed on the formation to determine whether the formation is likely to produce hydrocarbons of commercial value. Typically, tests performed on subsurface formations involve interrogating penetrated formations to determine whether hydrocarbons are actually present and to assess the amount of producible hydrocarbons therein. One approach to performing such tests is by means of formation testing tools, often referred to as formation testers.

Formation testing typically involves the use of certain preliminary tests, or pretests, that may be used to perform a relatively quick assessment of a formation at one or more depths. While such pretests are generally conducted relatively quickly, these tests can nevertheless introduce delays (e.g., drilling delays if the tests are performed by a tool located in a drilling assembly) that increase the non-productive time and the possibility of tools becoming stuck in the wellbore. To reduce such non-productive time and the possibility of sticking, drilling operation specifications based on prevailing formation and drilling conditions are often established to dictate how long a drill string may be immobilized in a given borehole. Under these specifications, the drill string may only be allowed to be immobile for a limited period of time to deploy a probe and perform a pressure measurement. Because formation testing operations are used throughout drilling operations, the duration of any testing (e.g., pretests) and the accuracy of the results of the testing achievable in the allotted time are major constraints that must be considered.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
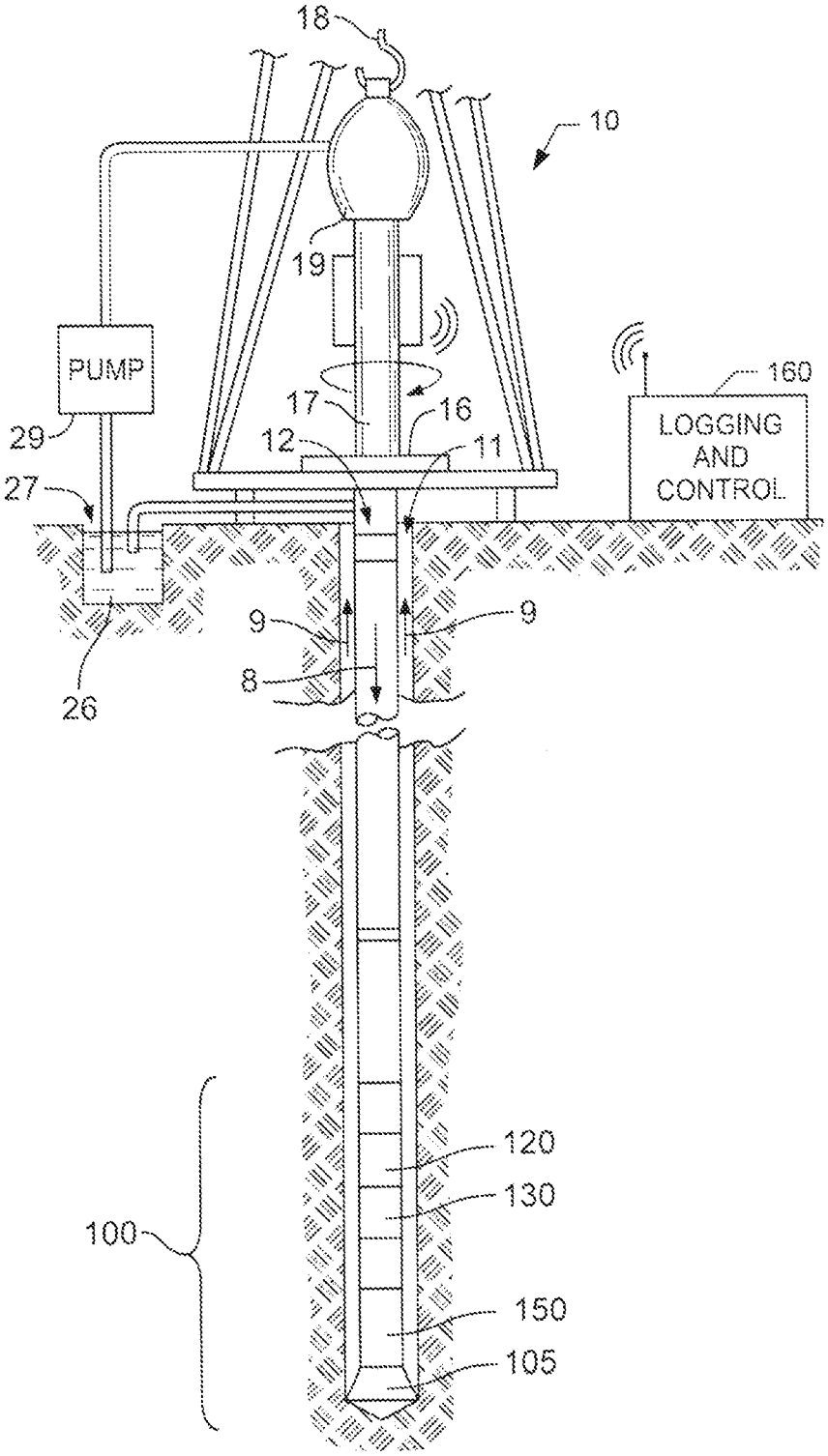
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

One or more aspects of the present disclosure relate to methods and apparatus to perform a drawdown of a formation fluid in a downhole environment. According to an aspect of the disclosure, formation properties (e.g., formation pressure, mobility, etc.) may be estimated by the disclosed methods, which may include an investigation phase and a measurement phase. In an example method, a sample probe or other fluid communication device of a formation testing tool is used to contact a borehole wall. During the investigation phase, a first type of drawdown is performed to draw fluid into the sample probe. According to an aspect of the disclosure, the first type of drawdown is a substantially continuous volume expansion. During the first type of drawdown, pressure data associated with the fluid is collected and analyzed to determine for example, a pattern or trend of the data, a deviation from the trend or pattern, a breach of a mudcake and/or a flow of fluid into the fluid communication device from the contacted formation. According to an aspect of the disclosure, these detections may be related. For example, the breach of the mudcake may be determined based on the deviation from the trend or pattern of data. In some examples, the trend or pattern corresponds to a slope or a best-fit line associated with a time-varying pressure.

The example methods may also include the performance of a second type of drawdown to draw fluid into the sample probe in response to the detections noted above such as, for example, in response to detecting the breach of the mudcake. According to an aspect of the disclosure, the second type of drawdown may be different from the first type of drawdown. For example, the second type of drawdown may be based on a step-wise or incremental volume expansion. The second drawdown could be used to confirm or verify the above-noted detection. For example, the second drawdown could confirm the breach of the mudcake based on the difference between one or more pressure buildups that occur after each step of a step-wise drawdown.

A buildup pressure following the second drawdown sequence may be used to determine a formation characteristic such as, for example, a formation pressure or a mobility, which may then be used to set or specify a test parameter such as, for example, a time, a volume or a flow rate to define or be used in a subsequent operational sequence of the tool such as, for example, a third type of drawdown to draw fluid into the formation testing tool. According to an aspect of the disclosure, the third type of drawdown is a drawdown used in a measurement test of the formation, i.e., during the measurement phase. Performance of the methods described herein facilitates accurate detection of a mudcake breach during the pretest in a reduced amount of time than what is experienced with known techniques.

Turning to the figures, FIG. 1 depicts a wellsite system including downhole tool(s) that may be operated according to one or more aspects of the present disclosure. The wellsite drilling system of FIG. 1 can be employed onshore or offshore. In the example wellsite system of FIG. 1, a borehole 11 is formed in one or more subsurface formations by rotary and/or directional drilling.

As illustrated in FIG. 1, a drill string 12 is suspended in the borehole 11 and includes a bottom hole assembly (BHA) 100 having a drill bit 105 at its lower end. A surface system includes a platform and derrick assembly 10 positioned over the borehole 11. The derrick assembly 10 includes a rotary table 16, a kelly 17, a hook 18 and a rotary swivel 19. The drill string 12 is rotated by the rotary table 16, energized by means not shown, which engages the kelly 17 at an upper end of the drill string 12. The example drill string 12 is suspended from the hook 18, which is attached to a traveling block (not shown), and through the kelly 17 and the rotary swivel 19, which permits rotation of the drill string 12 relative to the hook 18. Additionally, or alternatively, a top drive system could be used.

In the example depicted in FIG. 1, the surface system further includes drilling fluid 26, which is commonly referred to in the industry as "mud," and which is stored in a pit 27 formed at the well site. A pump 29 delivers the drilling fluid 26 to the interior of the drill string 12 via a port in the rotary swivel 19, causing the drilling fluid 26 to flow downwardly through the drill string 12 as indicated by the directional arrow 8. The drilling fluid 26 exits the drill string 12 via ports in the drill bit 105, and then circulates upwardly through the annulus region between the outside of the drill string 12 and the wall of the borehole 11, as indicated by the directional arrows 9. The drilling fluid 26 lubricates the drill bit 105, carries formation cuttings up to the surface as it is returned to the pit 27 for recirculation, and creates a mudcake layer (not shown) on the walls of the borehole 11.

The example bottom hole assembly 100 of FIG. 1 includes, among other things, any number and/or type(s) of logging-while-drilling (LWD) modules or tools (one of which is designated by reference numeral 120) and/or measuring-while-drilling (MWD) modules (one of which is designated by reference numeral 130), a rotary-steerable system or mud motor 150 and the example drill bit 105. The MWD module 130 measures the drill bit 105 azimuth and inclination that may be used to monitor the borehole trajectory.

The example LWD tool 120 and/or the example MWD module 130 of FIG. 1 may be housed in a special type of drill collar, as it is known in the art, and contains any number of logging tools, pressure measurement tools and, optionally, fluid sampling devices. The example LWD tool 120 includes capabilities for measuring, processing and/or storing information, as well as for communicating with the MWD module 130 and/or directly with the surface equipment, such as, for example, a logging and control computer 160.

The logging and control computer 160 may include a user interface that enables parameters to be input and or outputs to be displayed that may be associated with the drilling operation and/or the formation traversed by the borehole 11. While the logging and control computer 160 is depicted uphole and adjacent the wellsite system, a portion or all of the logging and control computer 160 may be positioned in the bottom hole assembly 100 and/or in a remote location.

Figure 2:
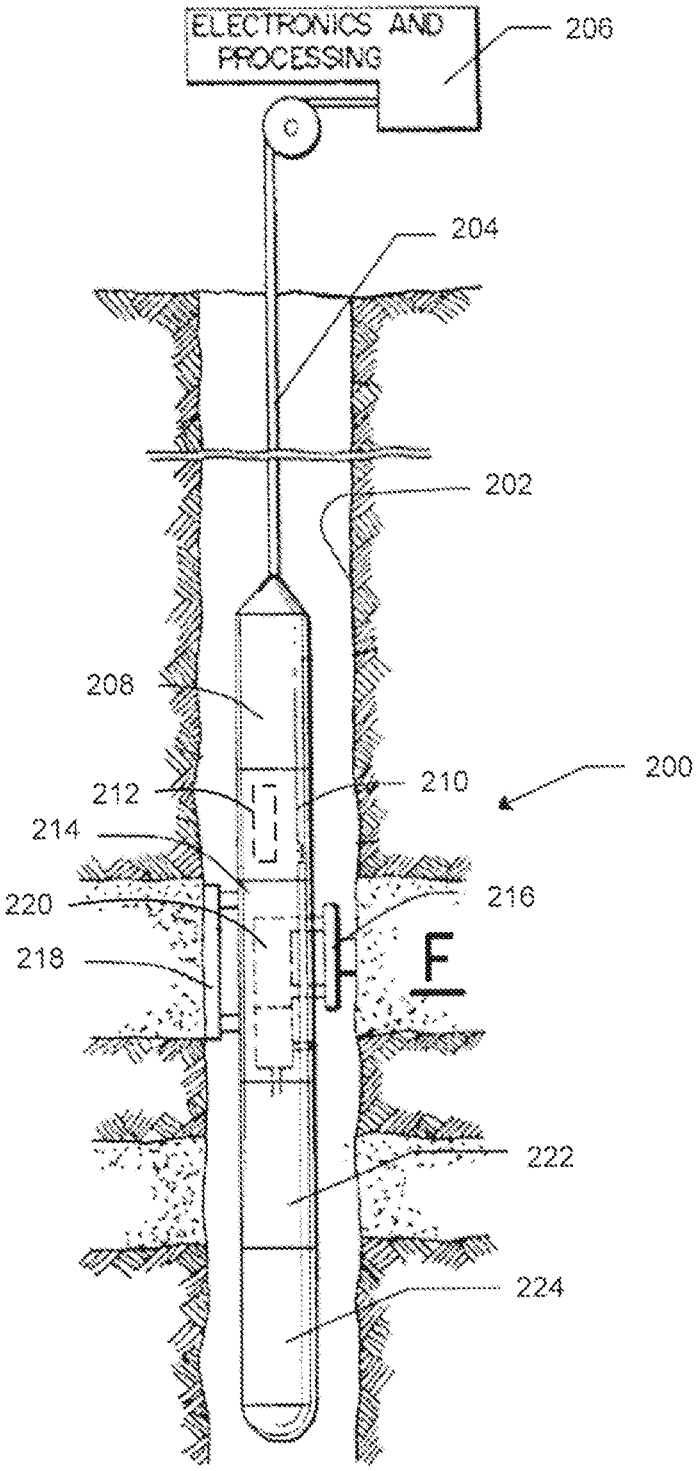
FIG. 2 is a schematic view of another apparatus according to one or more aspects of the present disclosure.

FIG. 2 depicts an example wireline system including downhole tool(s) according to one or more aspects of the present disclosure. The example wireline tool 200 may be used to measure formation pressure and, optionally, to extract and analyze formation fluid samples. The tool 200 is suspended in a borehole or wellbore 202 from the lower end of a multiconductor cable 204 that is spooled on a winch (not shown) at the surface. At the surface, the cable 204 is communicatively coupled to an electrical control and data acquisition system 206. The tool 200 has an elongated body 208 that includes a housing 210 having a tool control system 212 configured to control extraction of formation fluid from a formation F and measurements performed on the extracted fluid, in particular, pressure.

The wireline tool 200 also includes a formation tester 214 having a selectively extendable fluid admitting assembly 216 and a selectively extendable tool anchoring member 218, which in FIG. 2, are shown as arranged on opposite sides of the body 208. The fluid admitting assembly 216 is configured to selectively seal off or isolate selected portions of the wall of the wellbore 202 to fluidly couple to the adjacent formation F and draw fluid from the formation F. The formation tester 214 also includes a fluid analysis module 220 that contains at least one pressure measurement device, which is in pressure communication with the fluid entering the fluid admitting assembly 216 through which the obtained fluid flows. Once the test sequence has been completed the fluid entering the fluid admitting assembly may thereafter be expelled through a port (not shown) or it may be sent to one or more fluid collecting chambers 222 and 224, which may receive and retain the formation fluid for subsequent testing at the surface or a testing facility.

In the illustrated example, the electrical control and data acquisition system 206 and/or the downhole control system 212 are configured to control the fluid admitting assembly 216 to draw fluid samples from the formation F and to control the fluid analysis module 220 to perform measurements on the fluid. In some example implementations, the fluid analysis module 220 may be configured to analyze the measurement data of the fluid samples as described herein. In other example implementations, the fluid analysis module 220 may be configured to generate and store the measurement data and subsequently communicate the measurement data to the surface for analysis at the surface. Although the downhole control system 212 is shown as being implemented separate from the formation tester 214, in some example implementations, the downhole control system 212 may be implemented in the formation tester 214.

One or more modules or tools of the example drill string 12 shown in FIG. 1 and/or the example wireline tool 200 of FIG. 2 may employ the example methods and apparatus described herein to perform a drawdown of a formation fluid using a plurality of drawdown techniques and/or to detect and verify a mudcake breach using different drawdown techniques. For example, one or more of the LWD tool 120 (FIG. 1), the MWD module 130 (FIG. 1), the tool control system 212 (FIG. 2), and/or the formation tester 214 (FIG. 2) may utilize the example methods and apparatus described herein. While the example apparatus and methods described herein are described in the context of drill strings and/or wireline tools, they are also applicable to any number and/or type(s) of additional and/or alternative downhole tools such as coiled tubing deployed tools. Further, one or more aspects of this disclosure may also be used in other coring applications such as side-wall and/or in-line coring.

The methods described herein may be practiced with any formation tester known in the art, such as the testers described with respect to FIGS. 1 and 2. Other formation testers may also be used and/or adapted for one or more aspects of the present disclosure, such as the wireline formation tester of U.S. Pat. Nos. 4,860,581 and 4,936,139, the downhole drilling tool of U.S. Pat. No. 6,230,557 and/or U.S. Pat. No. 7,114,562, the entire contents of which are hereby incorporated by reference.

Figure 3:
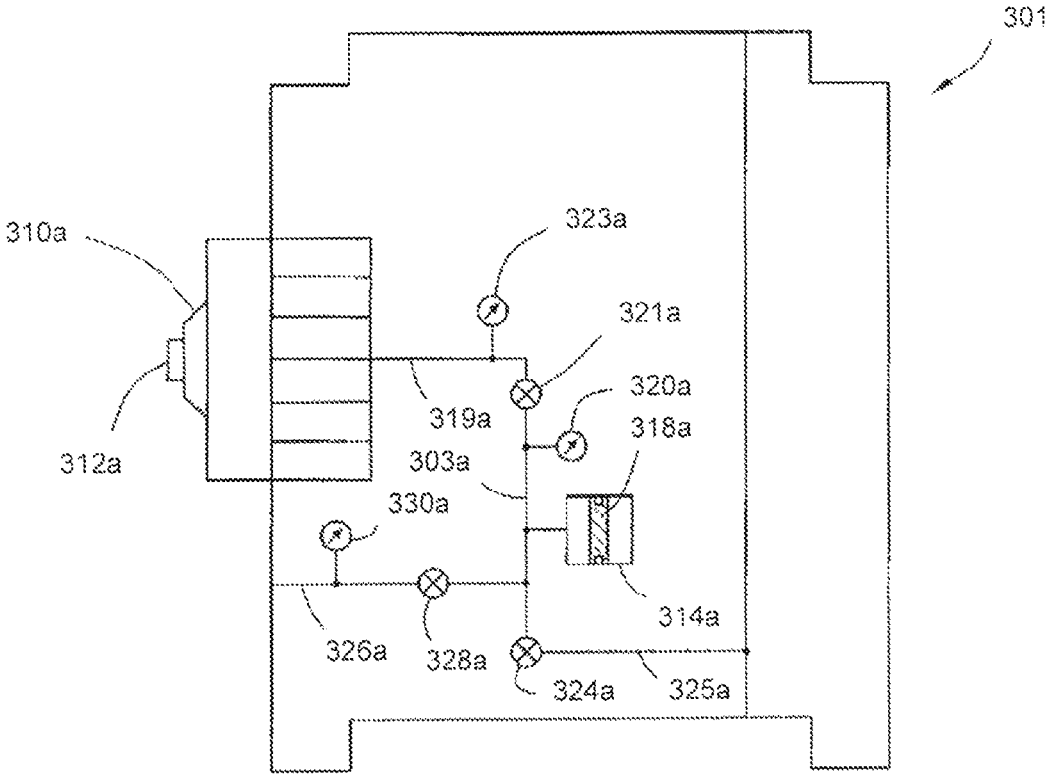
FIG. 3 is a schematic view of another apparatus according to one or more aspects of the present disclosure

A version of a fluid communication device or probe module 301 usable with such formation testers is depicted in FIG. 3. The module 301 includes a probe 312*a*, a packer 310*a* surrounding the probe 312*a*, and a flow line 319*a* extending from the probe 312*a* into the module 301. The flow line 319*a* extends from the probe 312*a* to a probe isolation valve 321*a*, and has a pressure gauge 323*a*. A second flow line 303*a* extends from the probe isolation valve 321*a* to sample line isolation valve 324*a* and an equalization valve 328*a*, and has pressure gauge 320*a*. A reversible pretest piston 318*a* in a pretest chamber 314*a* also extends from the flow line 303*a*. Exit line 326*a* extends from equalization valve 328*a* and out to the wellbore and has a pressure gauge 330*a*. Sample flow line 325*a* extends from sample line isolation valve 324*a* and through the tool. Fluid sampled in the flow line 325*a* may be captured, flushed, or used for other purposes.

The probe isolation valve 321*a* isolates fluid in the flow line 319*a* from fluid in the flow line 303*a*. The sample line isolation valve 324*a* isolates fluid in the flow line 303*a* from fluid in the sample line 325*a*. The equalizing valve 328*a* isolates fluid in a wellbore from fluid in a tool. By manipulating the valves 321*a*, 324*a* and 328*a* to selectively isolate fluid in the flow lines, the pressure gauges 320*a* and 323*a* may be used to determine various pressures. For example, by closing the valve 321*a*, formation pressure may be read by the gauge 323*a* when the probe is in fluid communication with the formation while minimizing the tool volume connected to the formation.

In another example, with the equalizing valve 328*a* open, mud may be withdrawn from the wellbore into the tool by means of the pretest piston 318*a*. Upon closing equalizing valve 328*a*, the probe isolation valve 321*a* and the sample line isolation valve 324*a*, fluid may be trapped within the tool between these valves and the pretest piston 318*a*. The pressure gauge 330*a* may be used to monitor the wellbore fluid pressure continuously throughout the operation of the tool and together with pressure gauges 320*a* and/or 323*a* may be used to measure directly the pressure drop across the mudcake and to monitor the transmission of wellbore disturbances across the mudcake for later use in correcting the measured sandface pressure for these disturbances.

Among other functions, the pretest piston 318*a* may be used to withdraw fluid from or inject fluid into the formation or to compress or expand fluid trapped between the probe isolation valve 321*a*, the sample line isolation valve 324*a* and the equalizing valve 328*a*. The pretest piston 318*a* preferably has the capability of being operated at low rates, for example 0.01 $cm^3$/sec, and high rates, for example 10 $cm^3$/sec, and has the capability of being able to withdraw large volumes in a single stroke, for example 100 $cm^3$. In addition, if it is necessary to extract more than 100 $cm^3$ from the formation without retracting the probe 312*a*, the pretest piston 318*a* may be recycled. The position of the pretest piston 318*a* preferably can be continuously monitored and positively controlled and its position can be locked when it is at rest. In some embodiments, the probe 312*a* may further include a filter valve (not shown) and a filter piston (not shown). One skilled in the art would appreciate that while these specifications define one example probe module, other specifications may be used without departing from the scope of the disclosure.

The techniques disclosed herein are also usable with other devices incorporating a flowline. The term "flowline" as used herein shall refer to a conduit, cavity or other passage for establishing fluid communication between the formation and the pretest piston and/or for allowing fluid flow there between. Other such devices may include, for example, a device in which the probe and the pretest piston are integral. An example of such a device is disclosed in U.S. Pat. Nos. 6,230,557 and 6,986,282, assigned to the assignee of the present disclosure, both of which are hereby incorporate by reference in their entireties.

Figure 4A:
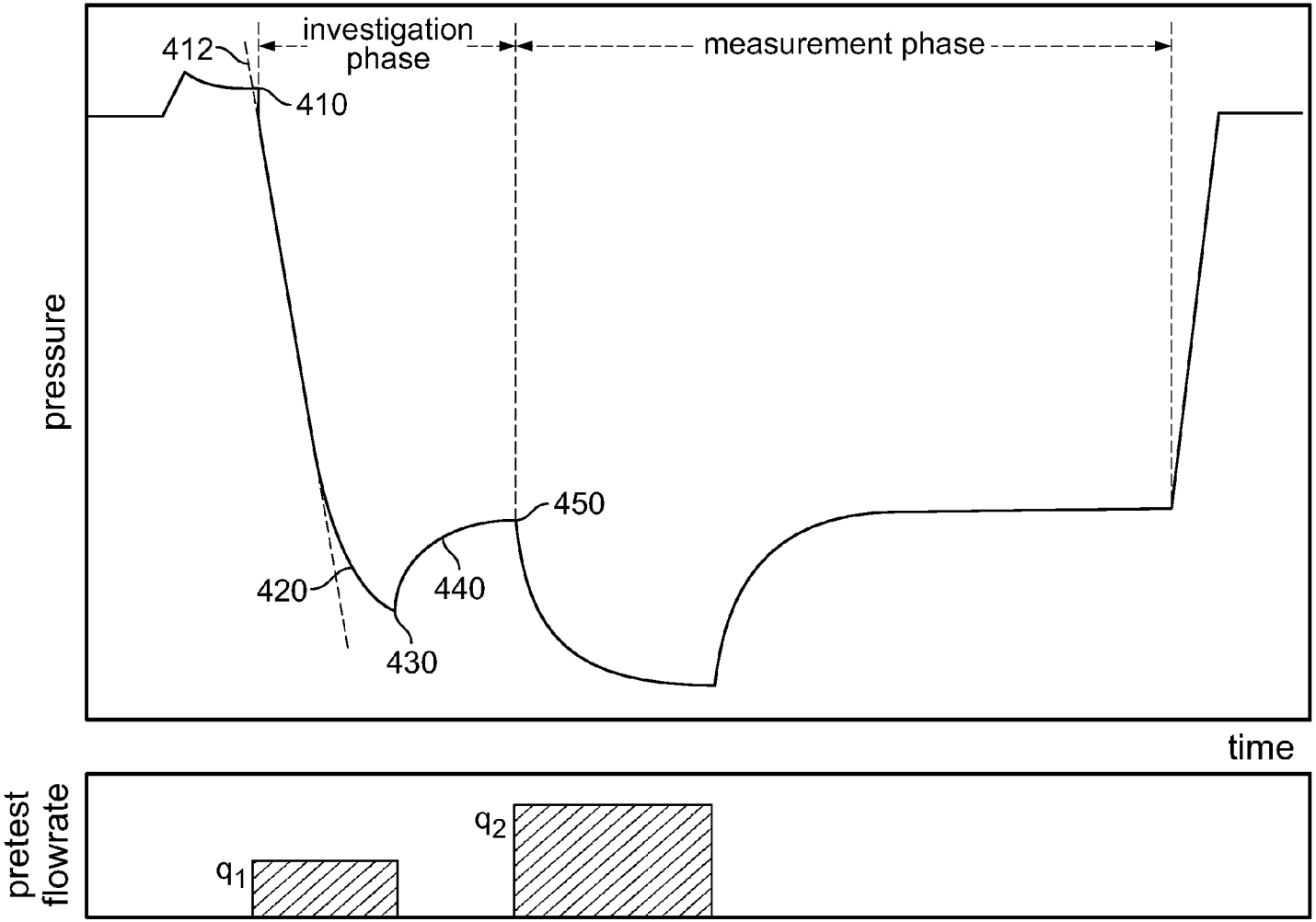
FIG. 4*a* is a graphical representation of a method according to one or more aspects of the present disclosure.

A first example of a type of drawdown which may be used during an investigation phase is shown in FIG. 4*a*. As noted above, parameters such as formation pressure and formation mobility may be determined from an analysis of the data derived from a pressure trace or curve of the investigation phase. For example, a termination point 450 represents a provisional estimate of the formation pressure. Alternatively, formation pressures may be estimated more precisely by extrapolating the pressure trend obtained during a buildup 440 using known techniques. Such an extrapolated pressure corresponds to the pressure that would have been obtained had the buildup been allowed to continue indefinitely.

Formation mobility $(K/\mu)_1$, the ratio of the formation permeability and the fluid viscosity, may also be determined from the buildup phase represented by the buildup line 440. Techniques known by those of skill in the art may be used to estimate the formation mobility from the rate of pressure change with time during the buildup 440.

Figure 4B:
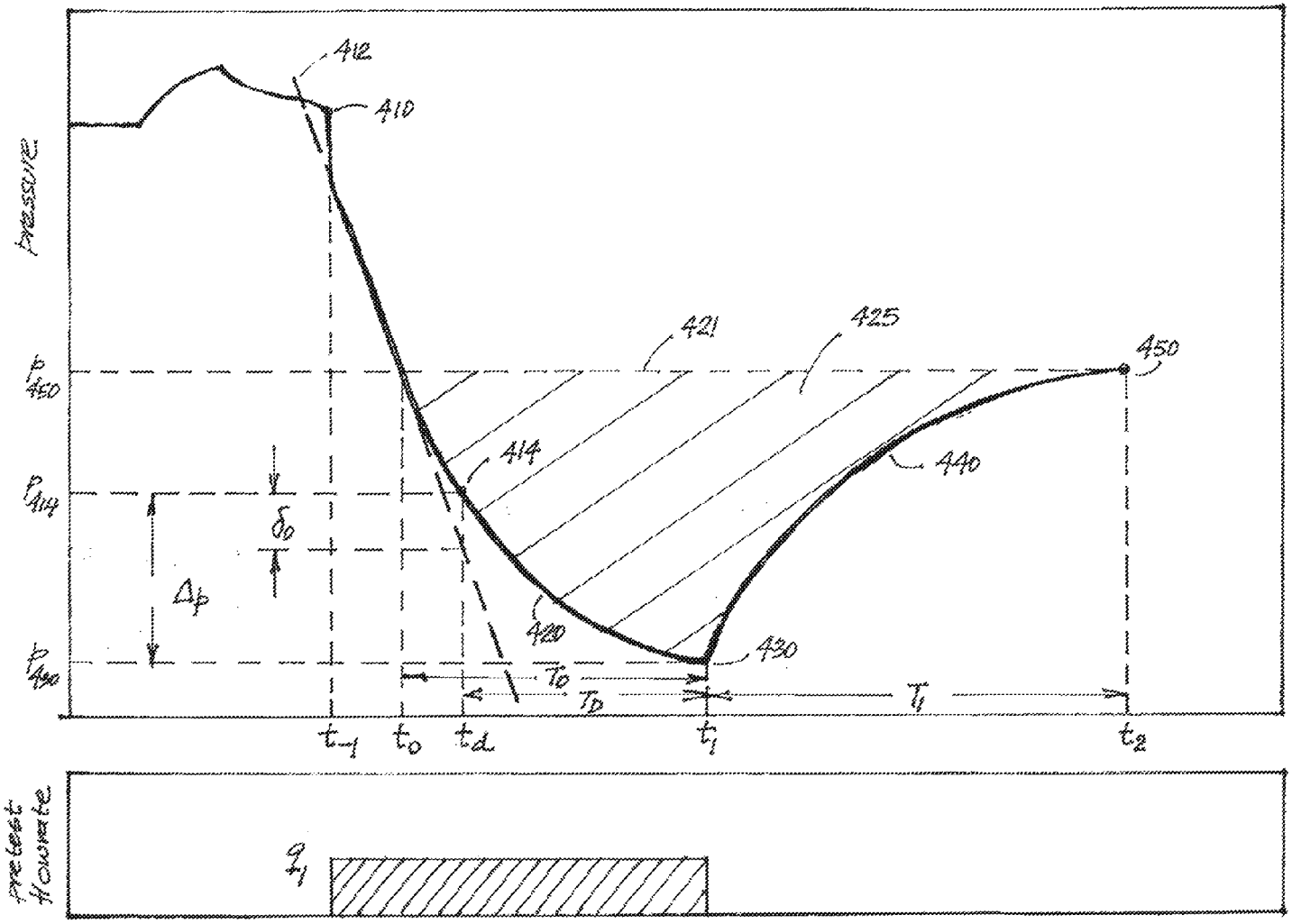
FIG. 4*b* is a graphical representation of a method according to one or more aspects of the present disclosure.

In addition, or alternately, the area of the graph of FIG. 4*b* depicted by the shaded region and identified by reference numeral 425 may be used to predict formation mobility. The area 425 is bounded by a line 421 extending horizontally from the termination point 450 (representing the estimated formation pressure $P_{450}$ at termination), a drawdown line 420 and the buildup line 440. The area 425 may be determined and related to an estimate of the formation mobility. Specifically, for a fluid admitting assembly 216 which allows treatment as a circular orifice situated on the wall of the borehole 11 (FIG. 1), the formation mobility (in units of Darcies/centiPoises) is known to be inversely proportional to the aforementioned area 425 (expressed in units of atmosphere-seconds). The proportionality constant is directly related to the volume of fluid extracted from the formation (expressed in $cm^3$), a constant that has a value close to unity that accounts for the presence of a finite radius borehole and is inversely related to twice the diameter of the fluid admitting probe. In using such a formula, it is assumed that the permeability of the formation being tested is isotropic, the flow is sufficiently slow that Darcy's relation for flow in porous media holds, the geometry of the flow is essentially spherical and the mobility is greater than approximately 0.5 milliDarcies/centiPoises. Under these conditions the error made in using such a formula is typically small (less than a few percent).

Referring still to FIG. 4*b*, the drawdown step or curve 420 of the investigation phase may be analyzed to determine the pressure drop over time to determine various characteristics of the pressure trace. A best-fit line 412 derived from points along the drawdown curve 420 is depicted extending from an initiation point 410. A deviation point 414 may be determined along the curve 420 representing the point at which the curve 420 reaches a prescribed deviation $\delta_0$ from the best-fit line 412. The deviation point 414 may be used as an estimate of the onset of fluid flow from the formation, that is, the point at which fluid from a formation being tested breaches the mudcake deposited on the borehole wall and enters the tool during the investigation phase drawdown.

The deviation point 414 may be determined by testing the most recently acquired pressure point to determine if it remains on the pressure trend representing the flowline expansion as successive pressure data are acquired. The deviation point 414 may also be determined by calculating the derivative of the pressure recorded during the drawdown 420 with respect to time. When the derivative changes (e.g., decreases) by, for example, 2-5%, the point at which this change occurs represents the beginning of fluid flow from the formation being sampled. If necessary, to confirm that the deviation from the expansion line represents flow from the formation, further small-volume pretests may be performed to verify the mudcake breach prior to conducting the measurement phase.

Once the deviation point 414 is determined, the drawdown is continued beyond the point 414 until some prescribed termination criterion is met. Such criteria may be based on pressure, volume and/or time. Once the criterion has been met, the drawdown is terminated and a termination point 430 is reached. It is desirable that the termination point 430 occur at a given pressure $P_{430}$ within a given pressure range $\Delta P$ relative to a deviation pressure $P_{414}$ corresponding to the deviation point 414 of FIG. 4*b*. Alternatively, it may be desirable to terminate drawdown within a given period of time following the determination of the deviation point 414. For example, if deviation occurs at time $t_d$, termination may be preset to occur by time $t_1$, where the time expended between the times $t_d$ and $t_1$ designated as $T_D$ and is limited to a maximum duration. Another criterion for terminating the pretest is to limit the volume withdrawn from the formation after the point of deviation 414 has been identified. This volume may be determined by the change in volume of the pretest chamber 314*a* (FIG. 3). The maximum change in volume may be specified as a limiting parameter for the pretest.

One or more of the limiting criteria, pressure, time and/or volume, may be used alone or in combination to determine the termination point 430. If, for example, as in the case of highly permeable formations, a desired criterion, such as a predetermined pressure drop, cannot be met, the duration of the pretest may be further limited by one or more of the other criteria.

After the deviation point 414 is reached, pressure continues to fall along the curve 420 until expansion terminates at the point 430. At this point, the probe isolation valve 321*a* is closed and/or the pretest piston 318*a* is stopped and the investigation phase buildup 440 commences. The buildup of pressure in the flowline continues until termination of the buildup occurs at point 450.

The pressure at which the buildup becomes sufficiently stable is often taken as an estimate of the formation pressure. The buildup pressure is monitored to provide data for estimating the formation pressure from the progressive stabilization of the buildup pressure. In particular, the information obtained may be used in designing a subsequent measurement phase transient such that a direct, stabilized measurement of the formation pressure is achieved at the end of the measurement phase buildup (FIG. 4*a*).

The investigation phase buildup should not be terminated before pressure has recovered to the level at which deviation from the flowline decompression was identified, i.e. the pressure designated by $P_{414}$ on FIG. 4*b*. In one approach, a set time limit may be used for the duration of the buildup $T_1$. $T_1$ may be set at some number, such as, for example, 2.5 times the time of flow from the formation $T_0$, or greater. In another approach, a time rate of change of pressure criterion may be used to limit the duration of the buildup $T_1$. For example, when the pressure change taken over three equally spaced (in time) pressure points is, after accounting for pressure measurement noise, less than twice the resolution of the pressure sensor, the buildup 440 could be taken to have stabilized.

Figure 5:
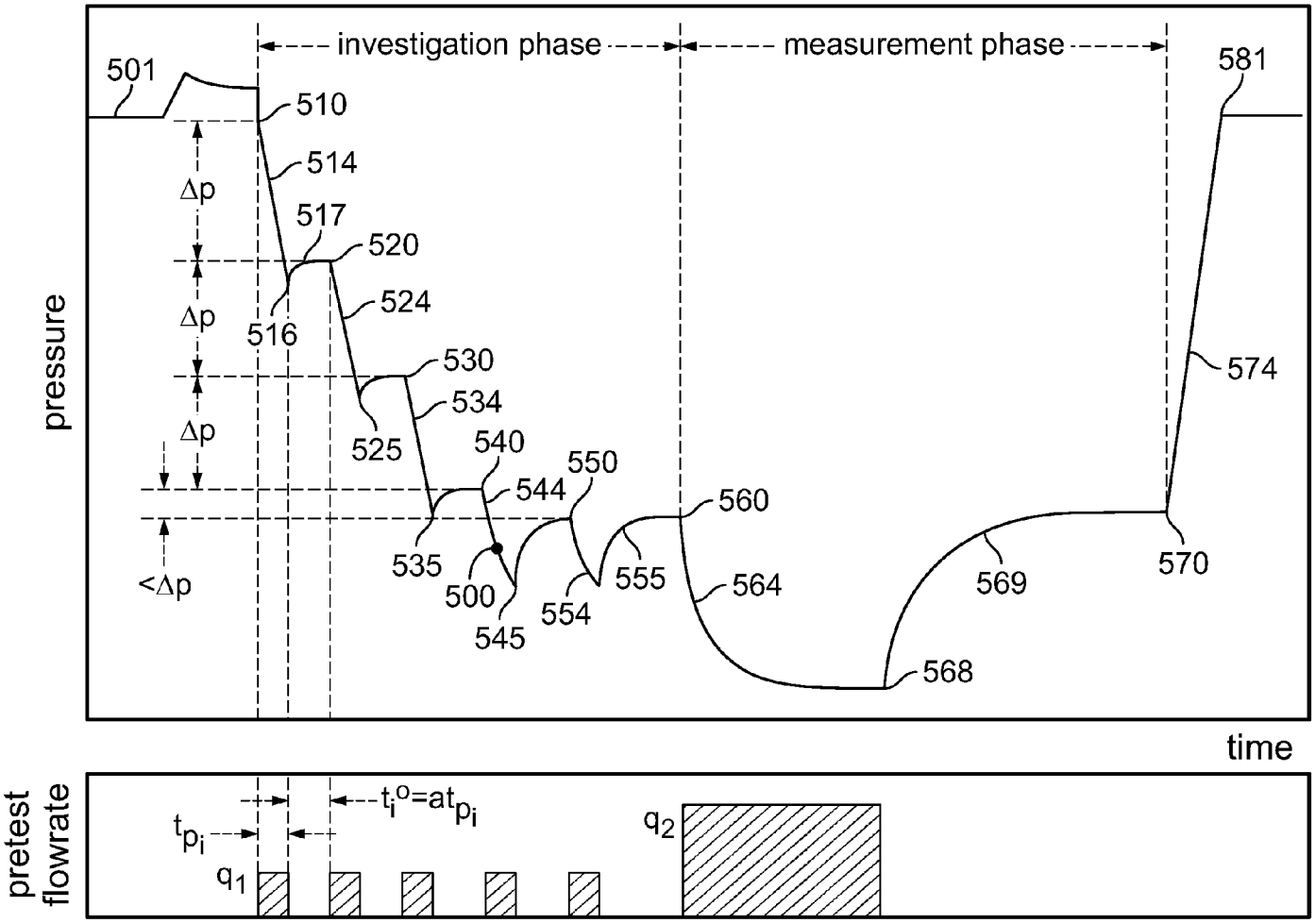
FIG. 5. is a graphical representation of a method according to one or more aspects of the present disclosure.

A second type of drawdown that may be used in an investigation phase is shown in FIG. 5. A wellbore fluid or mud hydrostatic pressure 501 is measured and the formation tester is set. After the tool is set, the pretest piston 318*a*, as shown in FIG. 3, is activated at activation point 510 to withdraw fluid at a precise, fixed rate to achieve a specified pressure drop during a drawdown 514 in a desired time. The desired pressure drop ($\Delta p$) may be of the same order but less than the expected overbalance at that depth, if the overbalance is approximately known. Overbalance is the difference in pressure between the mud hydrostatic pressure and the formation pressure. Alternatively, the desired pressure drop ($\Delta p$) may be some number (e.g., 300 psi) that is larger than the maximum expected value of the flow initiation pressure, that is, the pressure differential required to breach the mud cake (e.g., 200 psi). Whether the actual formation pressure is within this range is immaterial to the aspects of the present disclosure. Therefore, the following description assumes that the formation pressure is not within the range.

In accordance with one or more aspects of the present disclosure, the piston drawdown rate to achieve this limited pressure drop ($\Delta p$) may be determined from knowledge of the tool flowline volume, the desired pressure drop ($\Delta p$), the duration of the drawdown 514 and an estimate of the compressibility of the flowline fluid. The compressibility of the flowline fluid may be established by direct measurement within the downhole tool (as discussed above when referring to FIG. 3), or it may be estimated from previously obtained correlations for the particular mud utilized or by analysis of the slope of the initial stages of the drawdown 514, also as described above.

Referring to FIG. 5, a method of performing an investigation phase in accordance with one or more aspects of the present disclosure includes a second type of drawdown, which involves starting a drawdown at the activation point 510 and performing a controlled drawdown 514. According to some aspects of the disclosure, the piston drawdown rate is precisely controlled so that the pressure drop and the rate of pressure change are well controlled. However, it is not necessary to conduct the pretest (piston drawdown) at low rates. When the prescribed incremental pressure drop ($\Delta p$)

has been reached, the pretest piston is stopped and the drawdown is terminated 516. The pressure is then allowed to equilibrate 517 for a period $t_i^0$, which may be longer than the drawdown period $t_{pi}$, for example, $t_i^0$=a $t_{pi}$, where a in a number greater than or equal to 2.5 (FIG. 5). After the pressure has substantially stabilized, the pressure at a point 520 is compared with the pressure at the start of the drawdown at the activation point 510. A decision is then made as to whether to repeat the cycle. The criterion for the decision is whether the stabilized pressure (e.g., at the point 520) differs from the pressure at the start of the drawdown (e.g., at the activation point 510) by an amount that is substantially in agreement with the expected pressure drop (Δp). If so, then this flowline expansion cycle is repeated.

To repeat the flowline expansion cycle, for example, the pretest piston is re-activated and the drawdown cycle is repeated as described. Namely, initiation of the pretest 520, drawdown 524 by exactly the same amount (Δp) at substantially the same rate and duration as for the previous cycle, termination of the drawdown 525, and stabilization 530. Again, the pressures at 520 and 530 are compared to decide whether to repeat the cycle. As shown in FIG. 5, these pressures are significantly different and are substantially in agreement with the expected pressure drop (Δp) arising from expansion of the fluid in the flowline. Therefore, the cycle is repeated one or more times, 530-534-535-540 and 540-544-545-550. The flowline expansion cycle is repeated until the difference in consecutive stabilized pressures is substantially smaller than the imposed/prescribed pressure drop (Δp), shown for example in FIG. 5 as 540 and 550.

After the difference in consecutive stabilized pressures is substantially smaller than the imposed/prescribed pressure drop (Δp), the flowline expansion-stabilization cycle may be repeated one more time, shown as 550-554-555-560 in FIG. 5. If the stabilized pressures at 550 and 560 are in substantial agreement, for example within a small multiple of the gauge repeatability, the larger of the two values is taken as the first estimate of the formation pressure. Furthermore, the examples described herein are not limited by how many flowline expansion cycles or steps are performed. In addition, according to some aspects of the disclosure, after the difference in consecutive stabilized pressures is substantially smaller than the imposed/prescribed pressure drop (Δp), it is optional to repeat the cycle one or more times.

The point at which the transition from flowline fluid expansion to flow from the formation takes place is identified as 500 in FIG. 5. If the pressures at 550 and 560 agree at the end of the allotted stabilization time, it may be advantageous to allow the pressure 560 to continue to build and use the procedures described in previous sections to terminate the buildup to obtain a better first estimate of the formation pressure. The process by which the decision is made to either continue the investigation phase or to perform the measurement phase, 564-568-569, to obtain a final estimate of the formation pressure 570 is described in previous sections. After the measurement phase is completed 570, the probe is disengaged from the wellbore wall and the pressure returns to the wellbore pressure 574 within a time period and reaches stabilization at 581.

Once a first estimate of the formation pressure and the formation mobility are obtained in the investigation phase shown in FIG. 5, the obtained information may be used to establish the measurement phase pretest parameters that will produce more accurate formation characteristics within the allotted time for the test.

Figure 6:
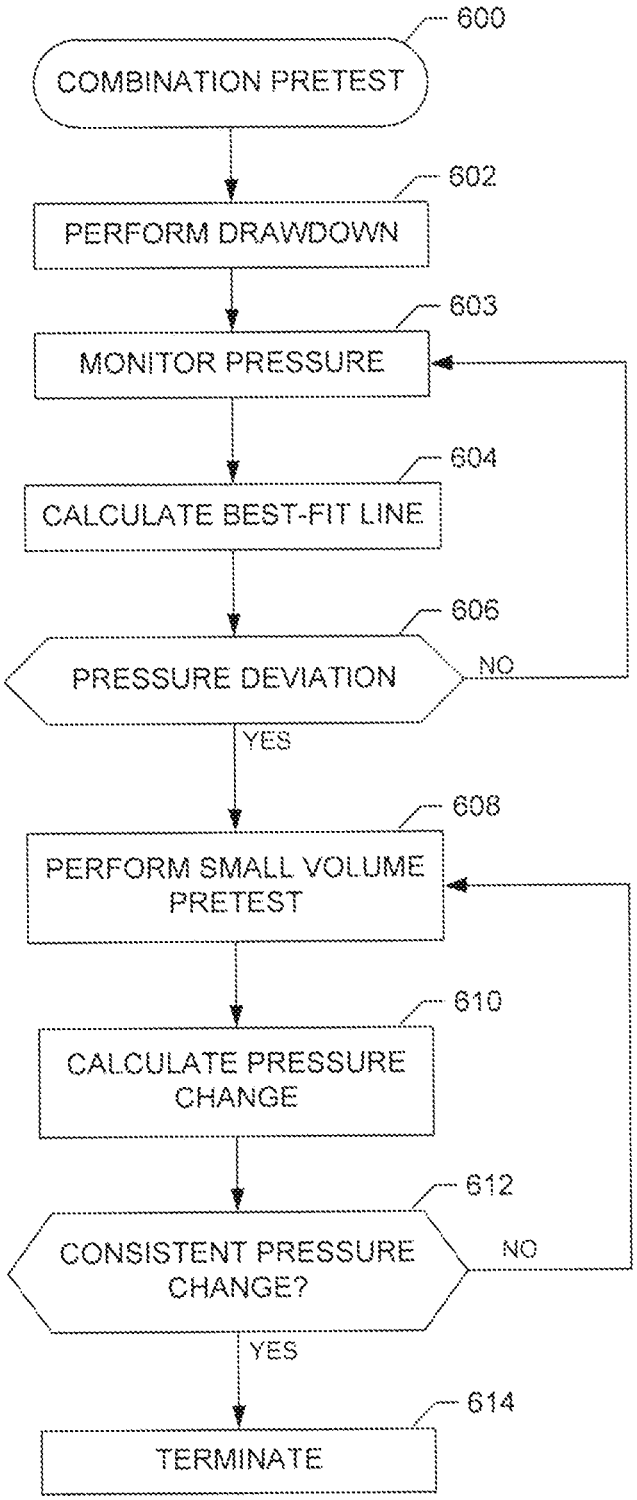
FIG. 6 is a flow-chart diagram of a method according to one or more aspects of the present disclosure.

In yet another example, the investigation phase includes a combination of investigation phases including or similar to those described above with respect to, for example, FIGS. 4*a*, 4*b* and 5 but where an event (e.g., a mudcake breach detection) in a first drawdown type prompts the performance of a second drawdown type. The example combination investigation method 600 is shown in FIG. 6. In general, the investigation method 600 commences with a drawdown or volume expansion (block 602). The pressure is continuously monitored (block 603), for example, in real-time to produce a pressure curve (e.g., the pressure versus time plot of FIG. 7). A best-fit line is calculated with the data provided by the pressure curve (block 604) (e.g., the best-fit line of FIG. 11). It is determined if the pressure data deviates (block 606) from the best-fit line by, for example, a predetermined factor. For example, a collected data point may be considered to have deviated if the data point is located at a distance from the best-fit line greater than three times the standard deviation of the data or a portion of the data, e.g., a the noise portion extant on the pressure data. In addition, a point may be considered deviated if the point causes a change in the pressure derivative with respect to time such as, for example, a 2-5% decrease, as noted above. A determination that the pressure data deviates from the best-fit line is an indication that the mudcake has been breached and that fluid has begun to flow into the formation tester.

After the pressure drawdown curve is determined to have deviated from the best-fit line, one or more small volume pretests are performed (block 608). In other words, once the mudcake breach is detected based on a deviation from the best-fit line in the substantially continuous drawdown, the type of drawdown used in the pretest changes to the small-volume type of pretests. The small-volume pretests collectively form a step-wise or incremental drawdown. The small-volume pretests include a drawdown of a small volume of fluid followed by a pressure stabilization step. The pressure change for the small-volume pretest is monitored (block 610) (e.g., the pressure versus time plot of FIG. 7). If the pressure change between successive small-volume pretests is large and/or inconsistent (block 612), subsequent small volume-pretests are performed (block 608). If the pressure change between successive small-volume pretests is small and/or consistent (block 612), the process 600 is terminated (block 614). A consistent pressure change or stable pressure is one that is within a certain factor or percentage of a desired pressure change such as, for example, 0.3 times the desired pressure change. A desired pressure change may correlate with the slope of the best-fit line described above. The breach of the mudcake is verified when there is consistent pressure change during the second type of drawdown, i.e., during the step-wise drawdown.

Figure 7:
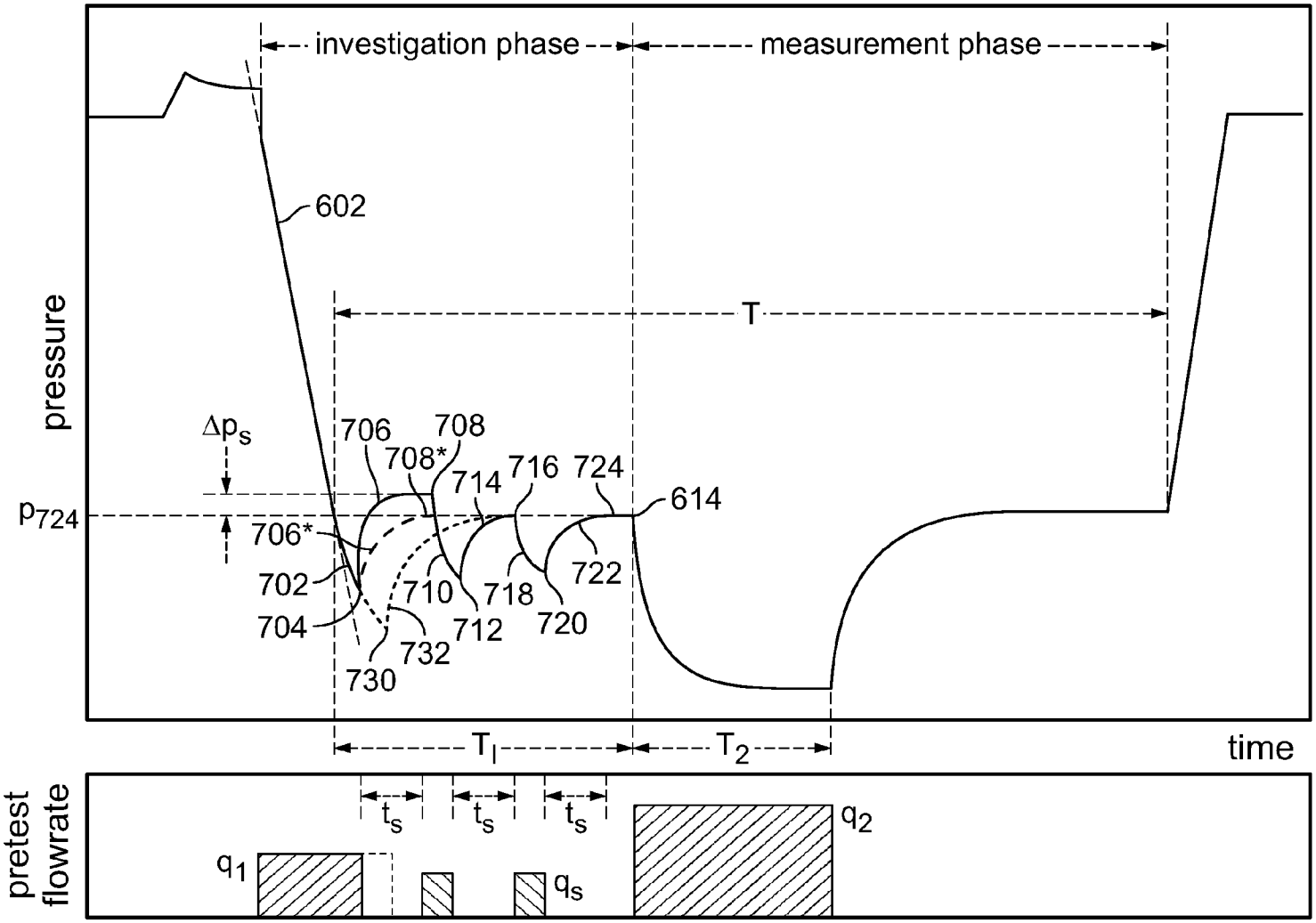
FIG. 7 is a graphical representation of a method according to one or more aspects of the present disclosure.
Figure 8:
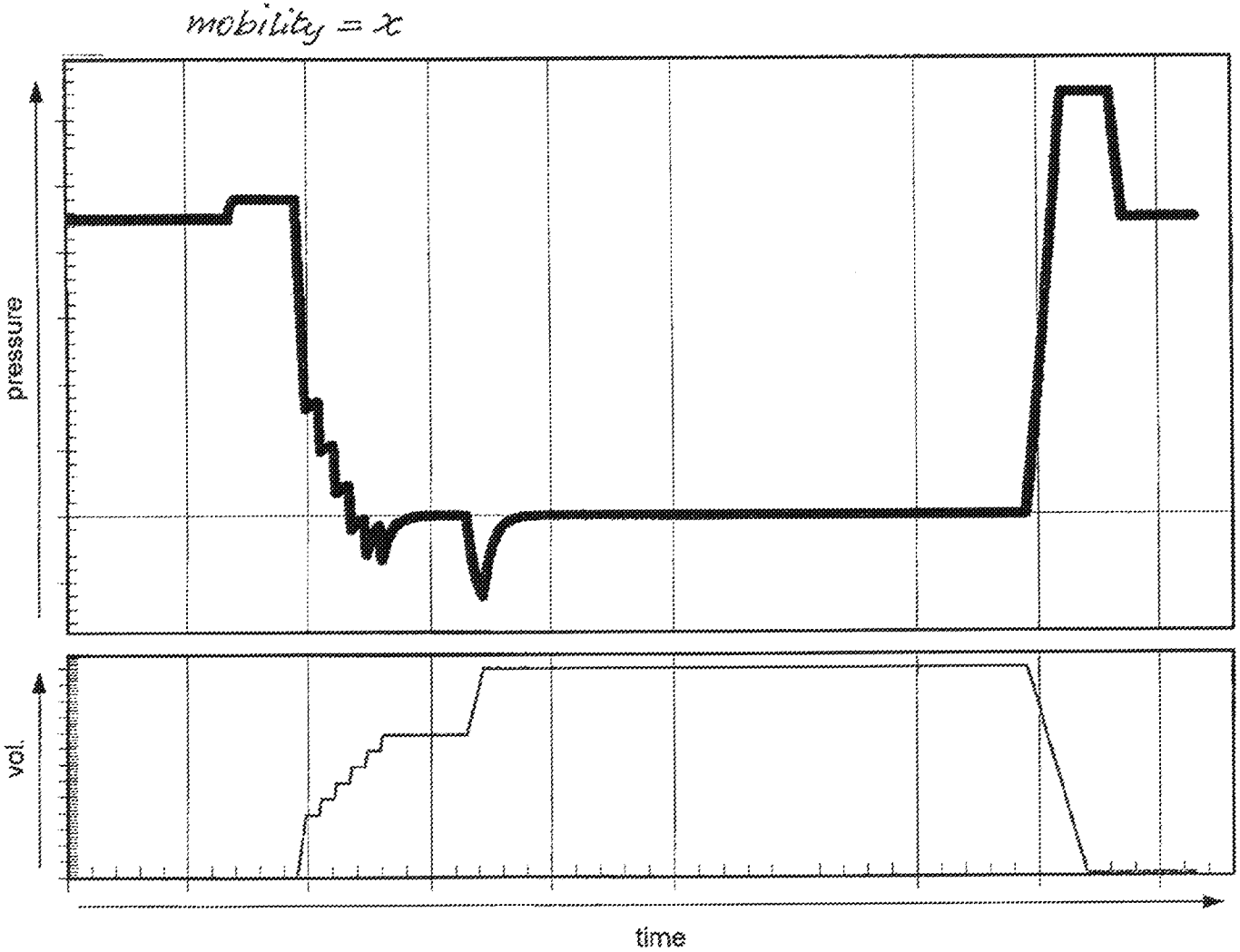
FIG. 8 is a graphical representation of a method according to one or more aspects of the present disclosure.
Figure 9:
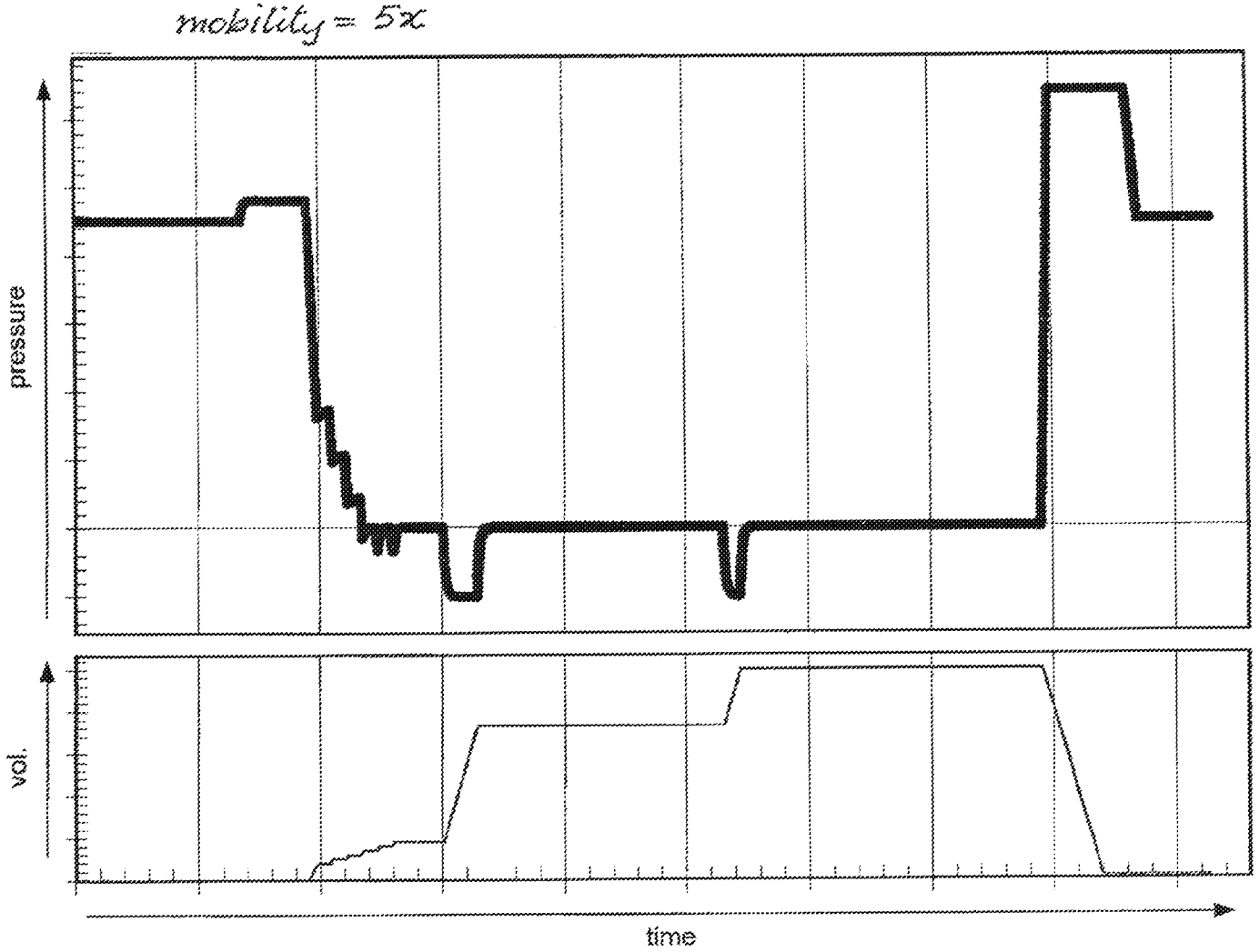
FIG. 9 is a graphical representation of a method according to one or more aspects of the present disclosure.
Figure 10:
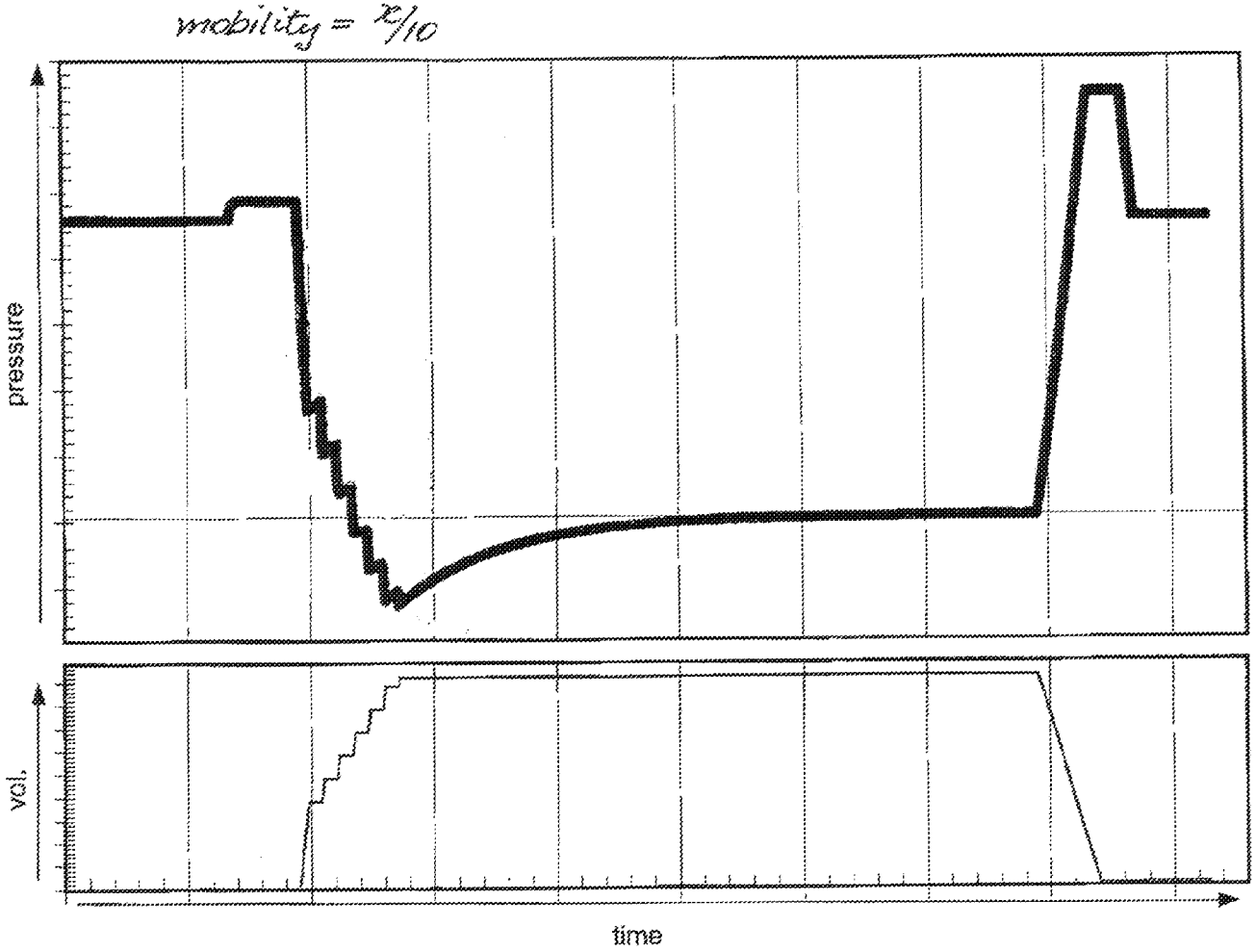
FIG. 10 is a graphical representation of a method according to one or more aspects of the present disclosure.
Figure 11:
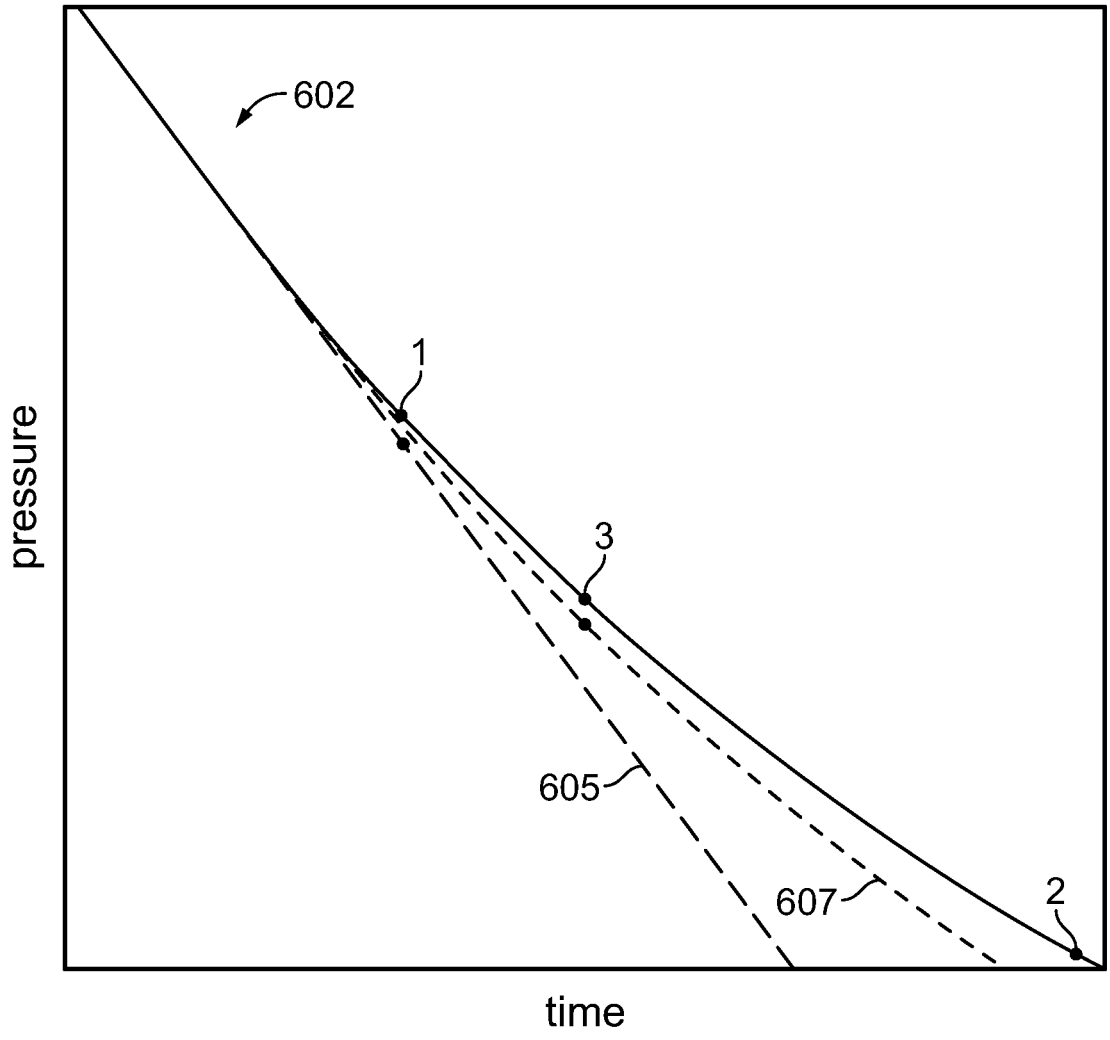
FIG. 11 is a graphical representation of a method according to one or more aspects of the present disclosure.

FIGS. 7-11 illustrate pressure versus time plots created during implementation of the example combination drawdown investigation phase pretest described herein. FIGS. 8, 9 and 10 present simulations of the method of FIG. 7 for a particular set of wellbore, formation and pretest parameters when the mudcake breach is poorly detected by the first type of drawdown. The sole parameter varied between the figures is the formation mobility where the formation mobility used to construct FIG. 9 is 5 times that of FIG. 8 and that of FIG. 10 is one tenth that of FIG. 8. FIG. 11 is an enlarged view of the portion of the drawdown 602 of the plot of FIG. 7.

The combination pretest described with reference to FIGS. 6-11 overcomes the shortcomings of the first pretest described with respect to FIGS. 4*a* and 4*b* and the prolonged time needed with respect to the second pretest described with respect to FIG. 5. For example, when there is a large overbalance between the well pressure and the actual formation pressure, the first pretest and the second pretest have limitations. Specifically, with regard to the first pretest, the flowline fluid expansion model described above, which provides the trend from which the deviation of measured flowline pressure is assessed, is no longer valid with large overbalances (and the consequent large expansion volumes) resulting in the need for a more comprehensive fluid expansion model. Uncertainties with respect to whether an actual mudcake breach occurred remain. With respect to the second type of pretest, when there is a large overbalance, the number of cycles or steps needed to obtain consistent pressure changes or a stable pressure within the desired parameters described above is increased, which directly increases the amount of time needed to perform the investigation pretest leaving less time and less chance to perform a successful measurement pretest. When the two pretests are combined, the less complex linear model of the first pretest type may be used to quickly estimate a mudcake breach, then the second pretest type verifies that the mudcake was actually breached, beginning at a pressure closer to the actual formation pressure, which decreases the number of cycles needed in the second pretest to verify the mudcake breach and estimate the actual formation pressure.

In greater detail and with reference to FIGS. 6 and 7, the combination investigation phase 600 is performed with a predefined volume limit $v_1$ and a pretest rate $q_1$ for performing the drawdown (block 602), which occurs after, e.g., two seconds, or for a period equal to or greater than the time required for the pretest motor to stabilize. Pressure data is gathered and monitored (block 603), which includes computing the fitted first-order derivative (slope of the pressure trend) at each pressure point (block 604), finding the median, minimum and maximum values of the slopes and determining a cut-off value of the slope that is between the median and the minimum values. The continuous pressure points defining a curve with slope between the cut-off value and the minimum value is found and linear least-squares fitting is performed to obtain the actual slope for these points. The slope is used to fit these points again to remove points with a large intersection value (indicative of outliers), then a linear least-squares is performed to obtain the final slope 605 (FIG. 11) and intersection value (not shown). With the slope and the intersection value, a linear model (described above) or a logarithmic (large volume expansion) model of the flowline fluid expansion can be constructed. The slope 605 is stored as the flowline expansion pressure slope.

The pressure data points are compared to the slope 605 to evaluate the deviation from the slope (block 606). For example, the current (latest) pressure point is analyzed to determine if the point causes the pressure drawdown curve to deviate from the fitted model (e.g., be removed from the slope 605 by a predetermined factor of the standard deviation of the data, e.g., the noise portion of the pressure data). If the point does not cause the pressure drawdown curve to deviate from the slope 605, the pressure continues to be monitored (block 603) and subsequent pressure data points are analyzed.

If the point causes the pressure drawdown curve to deviate from the slope 605, the mudcake is assumed breached (e.g., Point 1 in FIG. 11), as described above. Then, according to some aspects of the disclosure, the drawdown is continued for a predefined delta pressure, a volume or predefined small time period ($v_1/q_1$) (e.g., Point 2 in FIG. 11). A subsequent pressure data point, after the predefined delta pressure or volume, is analyzed with respect to its position relative to the slope 605. If the subsequent point causes the pressure drawdown curve to deviate, it is verified that the mudcake is actually breached. Otherwise, the mudcake is not considered breached, and analysis of subsequent data points resumes. Alternatively, once Point 2 in FIG. 11 (Point 730 in FIG. 7) has been reached, the first drawdown may be terminated 730 and a buildup 732 may be allowed to stabilize 716 using the same criteria as previously described for the first drawdown type. To confirm the breach of the mudcake one or more small-volume pretest(s) with predetermined parameters may subsequently be performed 718-720-722-724. In this case, if the difference in the pressures at 716 and 724 is small, for example some multiple of the pressure gauge repeatability or pressure gauge noise whichever is greater, the mud cake breach is said to have been confirmed. These are supplementary verifications that may occur during the first type of drawdown. However, in accordance with other aspects of the disclosure, these supplemental verifications may be omitted and the first detection of the mudcake breach (i.e., first deviation) directly prompts the commencement of the second drawdown type, as described herein.

In addition, or as an alternative to the linear algorithm applied above with respect to the first drawdown type, the mudcake breach may be determined using a logarithmic fitting algorithm. An example logarithmic fitting is shown below in Equation 1.

$$p(t) = p_0 - \frac{1}{c_m + \alpha(p_0 - p(t))}\ln\left(1 + \frac{q(t - t_0)}{V_0}\right) \qquad \text{Equation (1)}$$

where p(t) is the pressure at the entry point to the fluid admitting assembly at time t and q is the pretest piston rate. In Equation 1, $t_0$, $p_0$ and $V_0$ are determined from the linear fitting (the middle point from the linear fit is used here). The two parameters, $c_m$ and $\alpha$, which model a fluid whose compressibility is a linear function of pressure, can be obtained from the least-squares fitting 607 of Equation 1 to the drawdown pressure data (FIG. 11). When the pressure curve deviates sufficiently from the fitting curve 607, the mudcake is taken to have actually breached resulting in the onset of fluid flow from the formation (e.g., Point 3 in FIG. 11).

Once it is concluded that the mudcake has been breached using the process described above (either with the first deviation detection alone or in combination with the supplemental detection), the pretest drawdown is stopped and the buildup pressure is monitored for a limited short time period, $t_s$. Then the second drawdown type begins, which includes performance of a small-volume pretest (block 608). The pretest has pre-defined parameters, i.e. a small pretest volume limit $v_s$ and a low pretest rate $q_s$. After the pretest drawdown finishes, a pre-defined time $t_s$ is allowed to pass for buildup. The pressure difference between the end point of the buildup and the start point of the drawdown is recorded (block 610) as $\Delta p_s$. For example, in FIG. 7, there is a first drawdown 702 at the point the second drawdown type begins for a particular pressure drop until the drawdown terminates 704. The pressure then builds up 706 for a short period of time and the first buildup pressure 708 is read. The process is repeated so that there is a second drawdown 710 for a particular pressure drop until the drawdown terminates 712. The pressure then again builds up 714 for a short period of time and a second buildup pressure 716 is read. The difference between the first buildup pressure 708 and the second buildup pressure 716 is determined to calculate $\Delta p_s$.

The pressure change is compared to a pressure change that represents pure expansion of a volume of flowline fluid equal to the volume of the small-volume pretest. This pressure change may be directly computed from knowledge of the rate of pressure change experienced during flowline expansion, the rate at which the flowline expansion was performed and the volume of the small-volume pretest. If the pressure change is not within a predefined factor of the pressure change, for example, less than 0.3 times, then a subsequent small volume pretest is performed 718-720-722-724 and the subsequent steps are repeated until the pressure change is within the predefined factor of the desired pressure change, at which point the investigation phase may end 614. The primary sequence 702-704-706-708-710-712-714-716 shown in FIG. 7 illustrates a case where the mudcake was not breached but the resulting drawdown was close to the formation pressure. In this case the stabilized pressures at 708 and 716 are close but the difference, $\Delta p_s$, is still significant. The sequence **702-704-706*-708*-710-712-714-718** corresponds to the case where the mudcake breach is directly confirmed. In this case $\Delta p_s$ is very small and is related primarily to the performance of the pressure measurement system.

Figure 12:
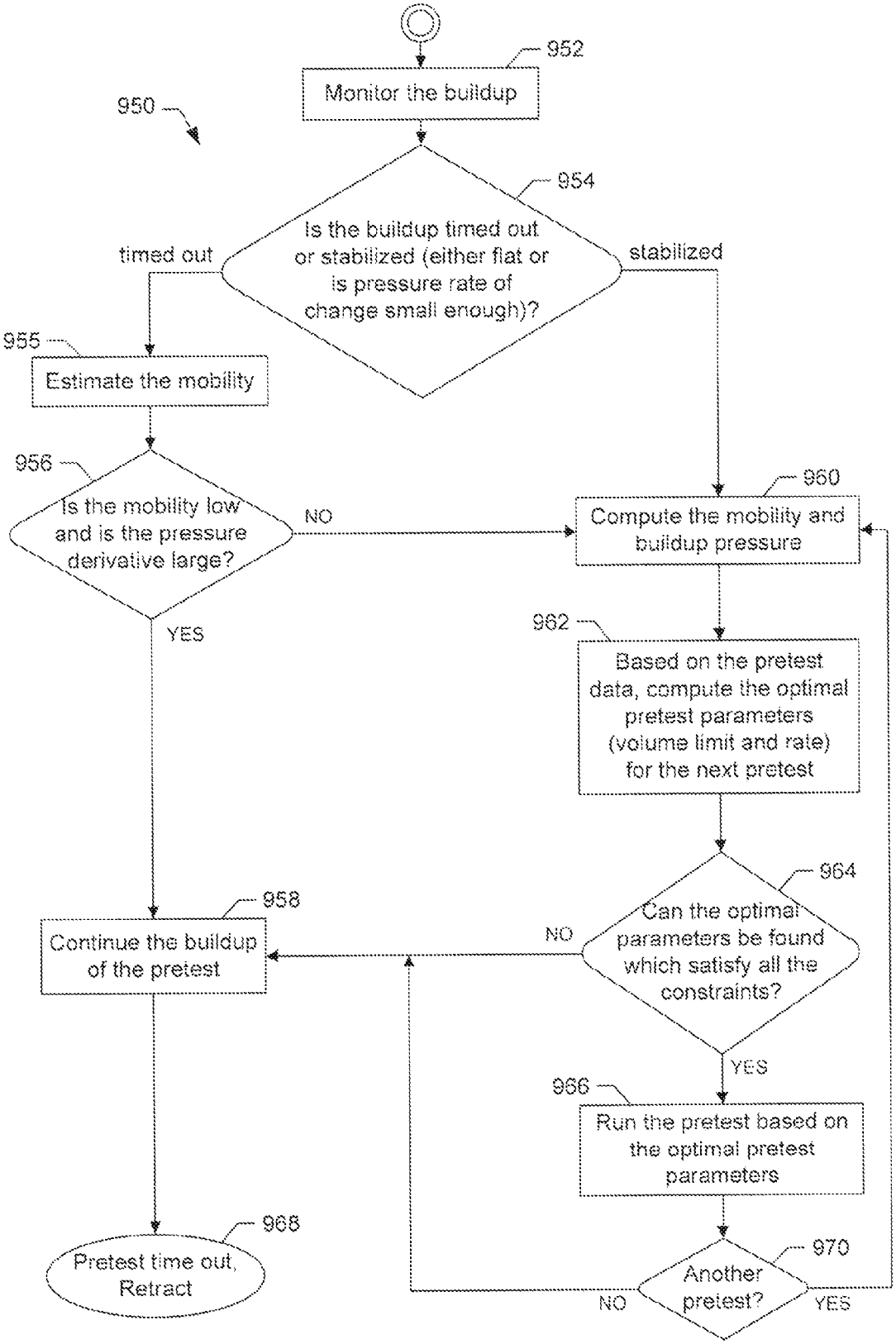
FIG. 12 is a flow-chart diagram of a method according to one or more aspects of the present disclosure.

FIG. 12 is a flow chart of an example method to optimize the measurement phase. With the pressure change within the predefined factor of the desired pressure change, the pretest will be below the formation pressure (i.e., the mudcake will be breached) and the measurement phase and optimization 950 may begin. Another small pretest (an investigation pretest) with volume limit $v_s$ and a pretest rate $q_s$ is performed and the pressure buildup is monitored (block 952) to determine if the pressure buildup is stable before the predefined time-out limit (block 954). If the pressure buildup is not stable (block 954) within the time limit, the process then estimates the mobility (block 955) and determines if the mobility is low and if the pressure derivative is large (i.e., the pressure is not stable) (block 956). If the estimated mobility is low, and the computation of the spherical derivative indicates that the buildup is not stable (block 956), the buildup continues (block 958) until retracting the tool (block 968).

However, if the pressure buildup is stable (small pressure derivative) and/or the mobility is not low, these values are calculated (block 960) and optimal pretest parameters for another pretest (the measurement pretest) are computed (block 962). Example parameters that are optimized include a volume limit, $v_2$, and a pretest rate, $q_2$. The computation of the optimized parameters considers constraints based on the investigation pretest and constraints related to the operation of the formation tester (block 964). These constraints ensure that the final buildup pressure is reasonably close enough to the formation pressure in a limited time period with a possibly large drawdown. If the optimal values can be obtained (block 964) (there is an optimal solution that also satisfies all the constraints), the measurement pretest is performed based on the optimal values (block 966). Otherwise, the investigation buildup will continue (block 958) until the tool is retracted (block 968).

In addition, if during buildup, the pressure derivative is small enough, and the flatness of the pressure buildup is close to the noise of the buildup, then the buildup is treated as stable, and another optimization (block 970) is performed based on the remaining time and the remaining volume (where, for example the pretest has pre-defined parameters such as a pretest volume limit, a pretest rate and/or a pretest time limit). If an optimal solution can be found, a second measurement pretest will be performed.

For the measurement pretest 950, at the end of the buildup, the pretest buildup pressure, p(T), should be within a desired neighborhood, δ, of the true formation pressure, $p_f$, where T denotes the time period measured from the point at which the flowline expansion 602 first goes below the indicated formation pressure, $p_{724}$, to the end of the test (FIG. 7). This will lead to constraints on the measurement phase pretest rate $q_2$ and duration of the measurement phase drawdown time $T_2$. For the purposes of illustration, suppose that $q_2$ is constant. Further, $T_1$ denotes the time period measured from the same origin as T to the beginning of the measurement phase drawdown. If pressure disturbances generated by the formation tester within the formation propagate outwardly as concentric spheres, the unit step response is known to be proportional to the complementary error function. $H(t|\Lambda)$ represents the unit step response at time t of the fluid admitting assembly-formation-fluid system. A is a short-hand notation for the collection of parameters that describe this system model—for example, Λ includes the formation mobility, the formation porosity, the total formation compressibility, the borehole dimensions, the formation thickness, the position of the fluid admitting assembly relative to the formation boundaries, and the dimensions of the fluid admitting assembly, amongst other parameters. The pressure difference between the formation pressure and the pressure at the fluid admitting assembly at the end of the test sequence may be expressed as shown in Equation 2.

$$\Delta p(T) = p_f - p(T) = q_2[H(T - T_1 \mid \Lambda) - H(T - T_1 - T_2 \mid \Lambda)] + \int_0^{T_1} q(x)H'(T - x \mid \Lambda)dx \quad \text{Equation (2)}$$

The prime over the unit step response function indicates that the derivative with respect to time is to be taken. Using the parameters obtained during the investigation phase and knowledge of the formations being tested to populate the parameter set Λ, the objective is to minimize Δp(T) with respect to $q_2$ and $T_2$ subject to the condition of Equation 3.

$$\Delta p(T) \leq \delta \quad \text{Equation (3)}$$

The collection of feasible pairs $\{q_2, T_2\}$ must satisfy conditions in addition to that expressed by Equation (3). In particular, the pretest rate can be no larger than the largest rate the formation tester can deliver, $q_{max}$, nor can it be less than the lowest operable rate, $q_{min}$. The drawdown time $T_2$ can be no larger than the time available after performing the investigation phase—in practice this means that the drawdown time is restricted to be less than approximately one third of the time available for the measurement phase. The product of the measurement pretest rate and the duration of the pretest, which represents the volume extracted during the measurement phase drawdown, can be no larger than the net pretest volume available after performing the investigation phase sequence, $V_{left}$. Further, the maximum pressure drop experienced during the measurement phase pretest may be limited by the power available to the formation tester, $\wp_{max}$, and/or the ability of the formation and its contained fluid to sustain a pressure drop, denoted by $\Delta p_{max}$. These restrictions may be formulated respectively as shown in Equations 4-7.

$$0 \le q_{min} \le q_2 \le q_{max} \quad \text{Equation (4)}$$

$$0 \le T_2 \le (T - T_1)/a \text{ where } a \ge 2.5 \quad \text{Equation (5)}$$

$$0 \le V_{min} \le q_2 T_2 \le V_{left} \quad \text{Equation (6)}$$

$$q_2 H(t - T_1 \mid \Lambda) + \int_0^{T_1} q(x) H'(t - x \mid \Lambda)\, dx - \Delta p_{max} \le 0 \quad \text{Equation (7)}$$

$T_f < t \le T_f + T_2$ and the maximum pressure drop can be constructed from known or previously derived information, for example as shown in Equation 8.

$$\Delta p_{max} = \min(\max(0, p_{f1} + \Delta p_{tool} - p_w), p_{f1}/b) \quad \text{Equation (8)}$$

In Equation 8, $p_{f1}$ is the formation pressure estimated during the investigation phase, $\Delta p_{tool}$ represents the maximum pressure drop capable of being sustained by the formation tester, $p_w$ is the wellbore pressure measured at the location of the fluid admitting assembly and b is a constant greater than or equal to 1. The condition that the power consumed during the measurement phase should not exceed the power available to the formation tester can be similarly formulated as shown in Equation 9.

$$q_2 \left[ q_2 H(t - T_1 \mid \Lambda) + \int_0^{T_1} q(x) H'(t - x \mid \Lambda)\, dx \right] - \wp_{max} \le 0 \quad \text{Equation (9)}$$

$\wp_{max}$ represents the maximum power available and all other symbols have the meanings assigned above. Typically the minimum pretest volume, $V_{min}$, may be set to zero to be compatible with Equation 5, unless there is some tool-related reason for maintaining a non-zero value.

Figure 13:
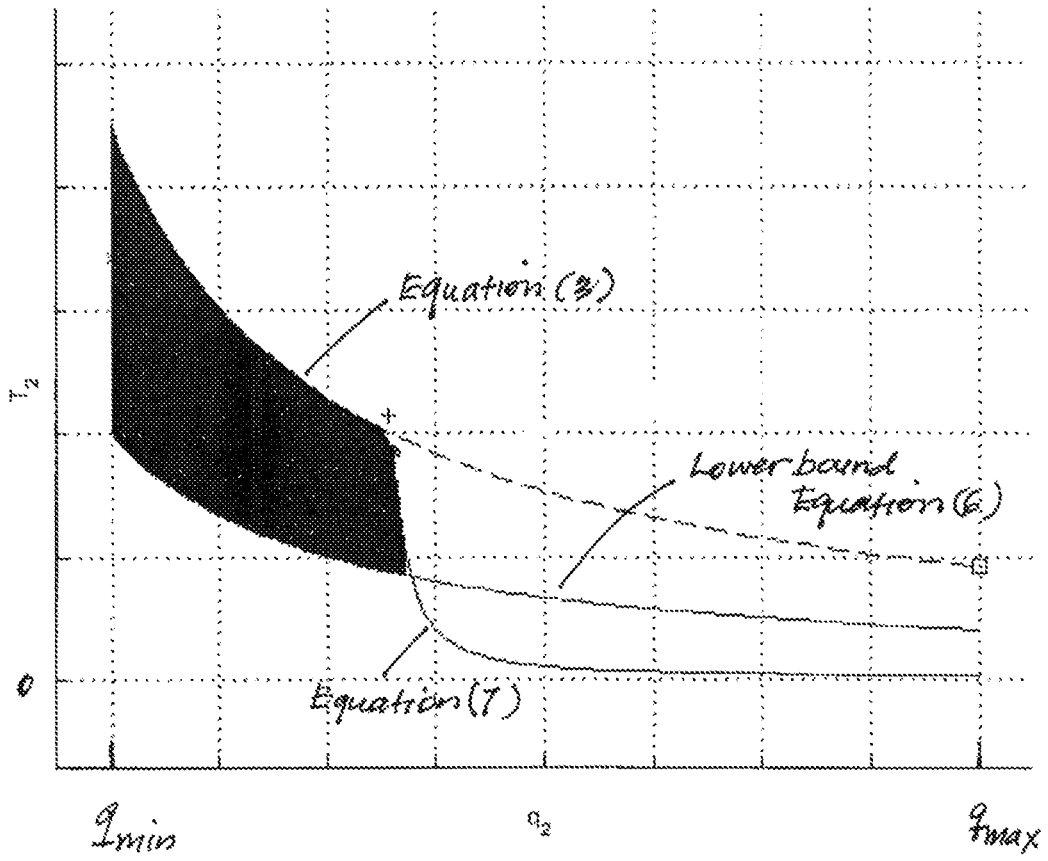
FIG. 13 is a graphical representation of a method according to one or more aspects of the present disclosure.

Not all the constraints may be simultaneously effective in restricting the feasible domain of the measurement phase pretest parameters $\{q_2, T_2\}$. For example, for formations with moderate to high mobilities the restrictions associated with the operational characteristics of the formation tester, as expressed by Equations 4, 6 and 9 predominate. On the other hand, for formations having a low mobility the restrictions imposed by Equation 3, the lower bounds of Equations 4 and 6 and the condition imposed by Equation 7 are paramount. FIG. 13 shows the feasible region for the case of a low mobility formation. The boundaries defined by the remaining conditions are outside the range of the axes presented in FIG. 13.

Under certain assumptions the optimization problem may be simplified by relating the bounds on $T_2$ to functions of $q_2$ thereby yielding a one-dimensional optimization problem. Such a formulation may have advantages in situations where the formation tester has limited downhole processing capabilities. Such simplifications are not material to the present disclosure and therefore will not be elaborated upon.

The methods available for solving the above stated minimization problem for the determination of the measurement phase pretest parameters are well known. One common approach seeks to minimize an objective function which has been suitably augmented to account for the influence of the effective constraints. One such form of amended objective function suitable for the determination of the measurement phase pretest parameters is shown in Equation 10.

$$J(q_2, T_2) = \left[ \alpha \left( \frac{\Delta p(T)}{\delta} \right)^2 + (1 - \alpha) \left( 1 - \frac{\Delta p(T_1 + T_2)}{\Delta p_{max}} \right)^2 \right] + \beta \cdot \left( 1 - \frac{q_2 T_2}{V_{max}} \right)^2 \quad \text{Equation (10)}$$

$$\text{where } \beta = \begin{cases} \alpha & \text{when } \alpha \ge 0.5 \\ 1 - \alpha & \text{otherwise} \end{cases}$$

$$\alpha = \frac{1}{2} \left( 1 - \tanh\left( \frac{4}{3} \log_{10}\left( \frac{2}{3} \frac{K}{\mu} \right) \right) \right)$$

$V_{max}$ is the maximum possible volume that satisfies all the constraints and $K/\mu$ is the formation mobility.

The first term in the measurement pretest optimization objective function indicates that the objective is to minimize the pressure difference between the fluid admitting assembly inlet and the formation pressure at the end of the buildup. However, when the pressure difference is small enough, this term does not meaningfully affect the overall objective. For example, when there may be a difference of 0.01 and 0.05 psi pressure difference at the end of the buildup.

The second term indicates that the objective is to encourage the pressure drawdown to be as large as possible, that is, to maximize the drawdown rate, $q_2$, within the set pressure drop constraints. In large mobility cases, this term will have a large weight, but for a low mobility case, this term will have a smaller weight compared to the first term.

The third term indicates that as much of the available and possible pretest volume which is compatible with achieving the pressure target at the end of the test should be used. Also, when the volume is large (close to the maximum possible volume), the effect due to a small volume discrepancy should be small, e.g., there should be no substantial difference to run a pretest at 10.5 cc volume limit or 10.8 cc volume limit.

Example methods and apparatus to perform a drawdown of a formation fluid in a downhole environment are described herein. The example methods may be used in one or more of an investigation phase and a measurement phase of a pre-test, to determine and/or verify mudcake breach or fluid flow, to specify an operating parameter of another portion of the pretest, to determine a formation characteristic and/or to optimize a measurement or pretest.

An example method includes contacting a borehole wall with a sample probe or fluid communication device of a formation testing tool and performing a first type of drawdown to draw fluid into the sample probe. The method also includes detecting a breach of a mudcake on the borehole wall during performance of the first type of drawdown and performing a second type of drawdown to draw fluid into the sample probe in response to detecting the breach of the mudcake. The second type of drawdown is different than the first type of drawdown. The method further includes confirming the breach of the mudcake on the borehole wall during performance of the second type of drawdown.

According to an aspect of the disclosure, the first type of drawdown is based on a substantially continuous volume expansion and the second type of drawdown is based on a step-wise volume expansion. In addition, the detecting of the breach of the mudcake includes collecting pressure data associated with the fluid and analyzing the pressure data to detect the breach of the mudcake. The analysis of the pressure data, in this example, includes comparing a first portion of the collected pressure data to a characteristic of a second portion of the collected pressure data where the first portion is collected after the second portion. The characteristic of the second portion may include at least one of a slope or a best-fit line associated with a time-varying pressure. Furthermore, according to an aspect of the disclosure, the comparison of the first portion to the characteristic of the second portion includes determining an amount by which the first portion deviates from the slope or the best-fit line. The method may further include determining a standard deviation of the second portion, and the determination of the amount by which the first portion deviates from the slope or the best-fit line includes determining a difference from the standard deviation. The difference may be a factor of the standard deviation, and the difference may be greater than a predefined limit. In addition, the determination of the mudcake breach may include detecting a difference between the first portion and the characteristic.

According to an aspect of the disclosure, the performance of the second type of drawdown includes a plurality of incremental or step-wise volume expansions including a first secondary volume expansion, a first preliminary pressure buildup, a second secondary volume expansion and a second preliminary pressure buildup. Confirmation or verification of the breach of the mudcake is based on a difference between the first preliminary pressure buildup and the second preliminary pressure buildup. In addition, a determination of a formation characteristic (e.g., a formation pressure or a mobility) may be based on one or more of the first preliminary pressure buildup or the second preliminary pressure buildup. For example, the formation characteristic may be a formation pressure based on the larger of the first preliminary pressure buildup and the second preliminary pressure buildup.

According to an aspect of the disclosure, the formation characteristic is used to specify a test parameter such as, for example, a time, a volume or a flow rate. The test may include a measurement phase that incorporates a third drawdown. The measurement phase may commence upon the confirmation or verification of the breach of the mudcake during the second type of drawdown.

An example apparatus described herein to perform a drawdown of a formation fluid in a downhole environment includes a formation testing tool having a sample probe or other fluid communication device and a processing unit to control a formation test to be performed by the formation testing tool. The processing unit processes pressure data collected by the formation testing tool to identify a breach of a mudcake layer in a borehole during performance of a first type of drawdown. The example processing unit also causes the formation testing tool to perform a second type of drawdown in response to identification of the breach of the mudcake layer. As noted above, the second type of drawdown is different than the first type of drawdown. In addition, the processing unit processes pressure data collected by the formation testing tool to confirm the breach of the mudcake layer in the borehole during performance of the second type of drawdown. According to an aspect of the disclosure, the processing unit also causes the formation testing tool to perform a third type of drawdown in response to the confirmation of the breach of the mudcake layer. The example processing unit is also capable of and configured to perform any other method described herein, or portion thereof.

As noted above, the disclosed testing procedures measure formation pressure during drilling operations by engaging the wellbore wall mechanically with part of the drilling assembly and performing a pressure test. Many of the properties of the downhole environment and operating conditions are challenging including that the properties of the formation at the test depth that determine the outcome of the test are unknown and may vary substantially over quite small distances, that there is the (very) limited two-way communication with the surface (operator), that the time allowed for the drilling assembly to remain stationary is very short and that there is very little tolerance on the part of drillers for nonproductive time, including repeated attempts to obtain the desired information. To increase the probability of success under these conditions, the tools described herein operate autonomously and the above-described test sequences can, first, derive approximate but valid information concerning the formation properties (the investigation phase) and then use this information to construct and execute test sequences which will result in precise formation information being acquired (the measurement phase) under the given time constraints. Each stage in the process is timely and robust and accurately determines when the tool has made positive hydraulic communication with the formation, i.e., when the mudcake has been breached and formation fluid is flowing or has flowed into the downhole tool. The processes described above involve an investigation phase that may be executed relatively quickly and/or robustness in detection of mudcake breach where the pressure is noisy, the formation mobility is low and/or the overbalance is large. In accordance with an aspect of the disclosure, the best values for the formation parameters are obtained, and the auxiliary measurements made in investigation phase are performed quickly, consistent with the robust detection of the mudcake breach, so that the time available for the measurement phase is as large as possible.

Furthermore, the apparatus and processes described herein are able to manage the time available to achieve a valid measurement under drilling conditions, which, as noted above, is short—i.e., a matter of a few minutes, and the very limited available two-way telemetry rates between the downhole tool and surface provided by traditional mud pulse telemetry schemes. Specifically, the apparatus and processes described herein include tool operating procedures that are, firstly, intelligent enough to operate the formation tester in an autonomous fashion to achieve a valid pressure measurement with very little prior information concerning the conditions under which the test is to be conducted and, secondly, to perform this procedure efficiently and with a high rate of success. The automated procedures described herein detect whether hydraulic communication has been established between the formation being tested and the downhole tool and acquire information relating to the ability of the formation to respond to an imposed disturbance, i.e., information relating to the static formation pressure and formation mobility. With this information and a model of the formation/formation tester system, a test sequence may be designed by means of algorithms within the downhole tool to achieve the test objectives in the time allotted for testing.

Also described herein is a system to perform a drawdown of a formation fluid in a downhole environment. The example system includes a wireline or a drill string and a formation testing tool coupled to the wireline or the drill string. The formation testing tool in this example includes any or all of the apparatus features described herein and is capable and/or configured to perform any of the methods described herein.

In view of all of the above and the figures, those skilled in the art will recognize that the present disclosure introduces a method comprising: performing a drawdown of a formation fluid, comprising: contacting a fluid communication device of a formation testing tool with a wall of a borehole extending into a subterranean formation; performing a first type of drawdown to draw fluid into the fluid communication device; detecting a breach of a mudcake on the borehole wall during performance of the first type of drawdown; performing a second type of drawdown to draw fluid into the fluid communication device in response to detecting the breach of the mudcake, wherein the second type of drawdown is different than the first type of drawdown; and confirming the breach of the mudcake on the borehole wall during performance of the second type of drawdown. One of the first and second types of drawdown may be based on a substantially continuous volume expansion. One of the first and second types of drawdown may be based on an incremental volume expansion. For example, one of the first and second types of drawdown may be based on a substantially continuous volume expansion, and the other of the first and second types of drawdown may be based on an incremental volume expansion. Detecting the breach of the mudcake may comprise collecting pressure data associated with the fluid and analyzing the pressure data to detect the breach of the mudcake. Analyzing the pressure data may comprise comparing a first portion of the collected pressure data to a characteristic of a second portion of the collected pressure data, wherein the first portion is collected after the second portion. The characteristic of the second portion may comprise at least one of a slope or a best-fit line associated with a time-varying pressure. Comparing the first portion to the characteristic of the second portion may comprise determining an amount by which the first portion deviates from the slope or the best-fit line. The method may further comprise determining a standard deviation associated with the second portion, wherein determining the amount by which the first portion deviates from the slope or the best-fit line may comprise determining a difference from the standard deviation. The difference may be a factor of the standard deviation. The difference may be greater than a predefined limit. Determining the mudcake breach may comprise detecting a difference between the first portion and the characteristic. The method may further comprise performing a third drawdown in response to the confirmation of the breach of the mudcake during the second type of drawdown. Performance of the second type of drawdown may include a plurality of step-wise volume expansions including a first secondary volume expansion, a first preliminary pressure buildup, a second secondary volume expansion and a second preliminary pressure buildup. Confirming of the breach of the mudcake may be based on a difference between the first preliminary pressure buildup and the second preliminary pressure buildup. The method may further comprise determining a formation characteristic based on one or more of the first preliminary pressure buildup or the second preliminary pressure buildup. The formation characteristic may be a formation pressure based on the larger of the first preliminary pressure buildup and the second preliminary pressure buildup. The formation characteristic may be one or more of a formation pressure or a mobility. The method may further comprise using the formation characteristic to specify a test parameter. The test parameter may be one or more of a time, a volume or a flow rate. The method may further comprise using the test parameter to define a subsequent operational sequence of the tool. The tool may be conveyed via a wireline or drill string. The fluid communication device may comprise a sample probe.

The present disclosure also introduces an apparatus comprising: an apparatus configured for conveyance in a borehole extending into a subterranean formation, wherein a mudcake layer exists on a wall of the borehole, the apparatus comprising: a formation testing tool comprising a fluid communication device and configured to collect pressure data; and a processing unit configured to: identify a breach of the mudcake layer during performance of a first type of drawdown, based on pressure data collected by the formation testing tool during performance of the first type of drawdown; cause the formation testing tool to perform a second type of drawdown in response to identification of the breach of the mudcake layer, wherein the second type of drawdown is different than the first type of drawdown; and confirm the breach of the mudcake layer during performance of the second type of drawdown, based on pressure data collected by the formation testing tool during performance of the second type of drawdown. The first type of drawdown may be a substantially continuous volume expansion. The second type of drawdown may be an incremental volume expansion. The processing unit may be configured to cause the formation testing tool to perform a third type of drawdown in response to the confirmation of the breach of the mudcake layer. The processing unit may be configured to use data from the second type of drawdown to estimate a formation characteristic. The formation characteristic may be a formation pressure. The processing unit may be configured to use the formation characteristic to determine a test parameter. The processing unit may be configured to determine a slope or a best-fit line for a first portion of the pressure data over time, and the breach of the mudcake when a second portion of the pressure data deviates from the slope or the best-fit line of the first portion of the pressure data. The fluid communication device may comprise a sample probe.

The present disclosure also introduces a system configured to perform a drawdown of a formation fluid in a downhole environment, comprising: a wireline or a drill string; and a formation testing tool coupled to the wireline or the drill string, the formation testing tool including: a fluid communication device configured to contact a borehole wall and convey formation fluid; and a processing unit configured to control a formation test to be performed by the formation testing tool, wherein the processing unit is configured to: process pressure data collected by the formation testing tool to identify a breach of a mudcake layer on the borehole wall during performance of a first type of drawdown; cause the formation testing tool to perform a second type of drawdown in response to identification of the breach of the mudcake layer, wherein the second type of drawdown is different than the first type of drawdown; and process pressure data collected by the formation testing tool to confirm the breach of the mudcake layer in the borehole during performance of the second type of drawdown. The first type of drawdown may be a substantially continuous volume expansion. The second type of drawdown may be an incremental volume expansion.

The present disclosure also introduces a method comprising: conveying a formation testing tool in a borehole penetrating a subterranean formation; contacting a wall of the borehole with a fluid communication device of the formation testing tool; performing a first type of drawdown to draw fluid into the formation testing tool via the fluid communication device while collecting pressure data associated with the fluid; determining a pressure trend of a first portion of the collected pressure data; detecting a deviation of a second portion of the collected pressure data from the pressure trend; and performing a second type of drawdown to draw fluid into the formation testing tool via the fluid communication device in response to detecting the deviation, wherein the second type of drawdown is different than the first type of drawdown. The method may further comprise: detecting a breach of a mudcake on the borehole wall during performance of the second type of drawdown; and performing a third type of drawdown to draw fluid into the formation testing tool in response to detecting the breach of the mudcake. The method may further comprise: detecting a flow of fluid through the borehole wall; and performing a third type of drawdown to draw fluid into the sample probe in response to detecting the flow of fluid through the borehole wall.

Though many examples have been described throughout this disclosure, any portion, or all portions, or any example can be combined, rearranged, joined or separated from any other part or whole or any example described herein.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure. Thus, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

contacting a fluid communication device of a formation testing tool with a wall of a borehole extending into a subterranean formation;

performing a first drawdown to draw fluid into the fluid communication device from a starting pressure of the first drawdown to a final pressure of the first drawdown via continuous expansion of a first volume of fluid within the formation testing tool, wherein the final pressure of the first drawdown is lower than a pressure of the subterranean formation;

detecting a breach of a mudcake on the borehole wall during the first drawdown and, in response to detecting the mudcake breach, performing a second drawdown to draw fluid into the fluid communication device via incremental expansion of a second volume of fluid within the formation testing tool, wherein the second volume of fluid is less than the first volume of fluid, wherein a starting pressure of the second drawdown is lower than the starting pressure of the first drawdown, and wherein performing the second drawdown includes performing a plurality of step-wise expansions of the second volume of fluid or other volumes of fluid, including:

performing a first secondary volume expansion; then allowing a first preliminary pressure buildup to a first buildup pressure; then performing a second secondary volume expansion; and then allowing a second preliminary pressure buildup to a second buildup pressure;

confirming the mudcake breach during the second drawdown;

estimating the pressure of the subterranean formation based on at least one of:

a pressure at which the mudcake breach was detected; and a pressure at which the mudcake breach was confirmed; and confirming the estimated pressure of the subterranean formation by performing a measurement phase comprising:

performing a third drawdown to draw fluid into the fluid communication device; and allowing a pressure buildup after the third drawdown.

2. The method of claim 1 further comprising, before confirming the estimated pressure of the subterranean formation, determining one of a third drawdown pressure change and a third drawdown volume based on the estimated pressure of the subterranean formation, wherein performing the third drawdown utilizes the determined one of the third drawdown pressure change and the third drawdown volume.

3. The method of claim 1 wherein detecting the mudcake breach comprises:

collecting first pressure data associated with the fluid drawn into the fluid communication device during the first drawdown;

generating a pressure versus time curve based on the collected first pressure data;

determining a best-fit line based on a first portion of the collected first pressure data;

and detecting the mudcake breach by detecting a deviation of a second portion of the collected first pressure data from the best-fit line.

4. The method of claim 1 wherein confirming the mudcake breach comprises:

performing incremental expansions of the second drawdown and allowing pressure buildup to a buildup pressure between each incremental expansion; and confirming the mudcake breach based on detection of a threshold difference between buildup pressures allowed between the incremental expansions.

5. The method of claim 1 wherein confirming the mudcake breach is based on a difference between the first and second buildup pressures.

6. The method of claim 1 wherein estimating the pressure of the subterranean formation is based on a larger one of the first and second buildup pressures.

7. The method of claim 6 wherein confirming the estimated pressure of the subterranean formation includes using the larger one of the first and second buildup pressures as a test parameter associated with at least one of the third drawdown and the pressure buildup after the third drawdown.

8. The method of claim 2 wherein the fluid communication device comprises a sample probe.

9. An apparatus, comprising:

a downhole apparatus operable for conveyance in a borehole extending into a subterranean formation, wherein a mudcake exists on a wall of the borehole, the downhole apparatus comprising:

a formation testing tool comprising a fluid communication device and operable for the collection of pressure data; and a processing unit operable to:

identify a breach of the mudcake during performance of a first drawdown, wherein the first drawdown draws fluid into the fluid communication device from a starting pressure of the first drawdown to a final pressure of the first drawdown via continuous expansion of a first volume of fluid within the formation testing tool, wherein the first drawdown continues until the final pressure of the first drawdown is lower than a pressure of the subterranean formation, and wherein the processing unit is operable to identify the mudcake breach based on pressure data collected by the formation testing tool during the first drawdown;

cause the formation testing tool to perform a second drawdown in response to identification of the mudcake breach, wherein the second drawdown draws fluid into the fluid communication device via incremental expansion of a second volume of fluid within the formation testing tool, wherein the second volume of fluid is less than the first volume of fluid, wherein a starting pressure of the second drawdown is lower than the starting pressure of the first drawdown, and wherein the second drawdown comprises a plurality of step-wise expansions of the second volume of fluid or other volumes of fluid, including:

performing a first secondary volume expansion; then allowing a first preliminary pressure buildup to a first buildup pressure; then performing a second secondary volume expansion; and then allowing a second preliminary pressure buildup to a second buildup pressure;

confirm the mudcake breach;

estimate the pressure of the subterranean formation based on at least one of:

a pressure at which the mudcake breach was detected; and a pressure at which the mudcake breach was confirmed; and cause the formation testing tool to perform a third drawdown using one or more pretest parameters determined based on the estimated pressure of the subterranean formation.

10. The apparatus of claim 9 wherein the processing unit is further operable to determine the one or more pretest parameters based on the estimated pressure of the subterranean formation.

11. The apparatus of claim 9 wherein the processing unit is further operable to:

analyze first pressure data associated with the fluid drawn into the fluid communication device during the first drawdown;

generate a pressure versus time curve based on the first pressure data;

determine a best-fit line based on a first portion of the collected first pressure data;

and identify the mudcake breach by detecting a deviation of a second portion of the collected first pressure data from the best-fit line.

12. The apparatus of claim 9 wherein the downhole apparatus is operable for conveyance in the borehole via a wireline or drill string.

13. The apparatus of claim 9 wherein the fluid communication device comprises a sample probe.

14. A method, comprising:

contacting a fluid communication device of a formation testing tool with a wall of a borehole extending into a subterranean formation;

performing a first drawdown to draw fluid into the fluid communication device from a starting pressure of the first drawdown to a final pressure of the first drawdown via continuous expansion of a first volume of fluid within the formation testing tool, wherein the final pressure of the first drawdown is lower than a pressure of the subterranean formation;

collecting first pressure data associated with the fluid drawn into the fluid communication device during the first drawdown;

generating a pressure versus time curve based on the collected first pressure data;

determining a best-fit line based on a first portion of the collected first pressure data;

detecting a breach of a mudcake on the borehole wall by detecting a deviation of a second portion of the collected first pressure data from the best-fit line;

performing, in response to detecting the mudcake breach, a second drawdown to draw fluid into the fluid communication device via incremental expansion of a second volume of fluid within the formation testing tool, wherein the second volume of fluid is less than the first volume of fluid, wherein a starting pressure of the second drawdown is lower than the starting pressure of the first drawdown, and wherein performing the second drawdown includes performing a plurality of step-wise expansions of the second volume of fluid or other volumes of fluid, including:

performing a first secondary volume expansion; then allowing a first preliminary pressure buildup to a first buildup pressure; then performing a second secondary volume expansion; and then allowing a second preliminary pressure buildup to a second buildup pressure;

confirming the mudcake breach during the second drawdown by:

performing incremental expansions of the second drawdown and allowing pressure buildup to a buildup pressure between each incremental expansion of the second drawdown; and confirming the mudcake breach based on detection of a threshold difference between buildup pressures allowed between the incremental expansions of the second drawdown;

estimating the pressure of the subterranean formation based on at least one of:

a pressure at which the mudcake breach was detected; and a pressure at which the mudcake breach was confirmed;

determining a third drawdown pressure change and a third drawdown volume based on the estimated pressure of the subterranean formation; and confirming the estimated pressure of the subterranean formation by performing a measurement phase comprising:

performing a third drawdown to draw fluid into the fluid communication device within the formation testing tool in response to the third drawdown pressure change; and allowing a final pressure buildup after the third drawdown.

15. The method of claim 14 wherein confirming the mudcake breach is based on a difference between the first and second buildup pressures.

16. The method of claim 14 wherein:

estimating the pressure of the subterranean formation is based on a larger one of the first and second buildup pressures; and confirming the estimated pressure of the subterranean formation includes using the larger one of the first and second buildup pressures as a test parameter associated with at least one of the third drawdown and the final pressure buildup after the third drawdown.

17. The method of claim 14 further comprising conveying the formation testing tool within the borehole via a wireline or drill string before contacting the fluid communication device with the borehole wall, wherein contacting the fluid communication device with the borehole wall comprises establishing fluid communication between a probe of the fluid communication device and the subterranean formation.

* * * * *